US008193489B2

(12) United States Patent
Bertsch et al.

(10) Patent No.: US 8,193,489 B2
(45) Date of Patent: Jun. 5, 2012

(54) CONVERGING MULTIPOLE ION GUIDE FOR ION BEAM SHAPING

(75) Inventors: James L. Bertsch, Palo Alto, CA (US); Michael Ugarov, San Jose, CA (US)

(73) Assignee: Agilent Technologies, Inc., Santa Clara, CA (US)

( * ) Notice: Subject to any disclaimer, the term of this patent is extended or adjusted under 35 U.S.C. 154(b) by 243 days.

(21) Appl. No.: 12/474,160

(22) Filed: May 28, 2009

(65) Prior Publication Data

US 2010/0301210 A1 Dec. 2, 2010

(51) Int. Cl.
*H01J 49/06* (2006.01)

(52) U.S. Cl. ..... 250/292; 250/281

(58) Field of Classification Search ..... 250/290, 250/281–282

See application file for complete search history.

(56) References Cited

U.S. PATENT DOCUMENTS

| | | | | |
|---|---|---|---|---|
| 5,847,386 | A | 12/1998 | Thomson et al. | |
| 6,417,511 | B1 * | 7/2002 | Russ et al. | 250/292 |
| 6,674,071 | B2 | 1/2004 | Franzen et al. | |
| 6,730,904 | B1 * | 5/2004 | Wells | 250/292 |
| 7,064,322 | B2 | 6/2006 | Crawford et al. | |
| 2007/0057178 | A1 * | 3/2007 | Chernushevich et al. | 250/288 |
| 2007/0164213 | A1 * | 7/2007 | Javahery et al. | 250/292 |
| 2008/0265154 | A1 * | 10/2008 | Cousins et al. | 250/288 |
| 2008/0315086 | A1 | 12/2008 | Kovtoun | |
| 2009/0090853 | A1 | 4/2009 | Schoen et al. | |
| 2010/0176295 | A1 * | 7/2010 | Senko et al. | 250/292 |

FOREIGN PATENT DOCUMENTS

| | | |
|---|---|---|
| EP | 2386112 | 11/2011 |
| GB | 2341270 | 3/2000 |
| GB | 2422051 | 7/2006 |
| GB | 2422051 | 12/2006 |
| WO | WO2010080850 | 7/2010 |

OTHER PUBLICATIONS

GB Intellectual Property Office, Search Report under Section 17, Jul. 30, 2010.
Search Report for GB1117344.0 mailed Oct. 31, 2011.

* cited by examiner

*Primary Examiner* — Jack Berman
*Assistant Examiner* — David E Smith

(57) ABSTRACT

A multipole ion guide comprises rods disposed about an axis, each of the rods having a first end and a second end remote from the first end. Each of the rods is disposed at a respective greater distance from the axis at the first end than at the second end. The multipole ion guide comprises means for applying a radio frequency (RF) voltage between adjacent pairs of rods, wherein the RF voltage creates a multipole field in a region between the rods; and means for applying a direct current (DC) voltage drop along a length of each of the rods. A mass spectroscopy system is also disclosed.

22 Claims, 19 Drawing Sheets

CONVERGING MULTIPOLE ION GUIDE FOR ION BEAM SHAPING

BACKGROUND

Mass spectrometry (MS) is an analytical methodology used for quantitative elemental analysis of samples. Molecules in a sample are ionized and separated by a spectrometer based on their respective masses. The separated analyte ions are then detected and a mass spectrum of the sample is produced. The mass spectrum provides information about the masses and in some cases the quantities of the various analyte particles that make up the sample. In particular, mass spectrometry can be used to determine the molecular weights of molecules and molecular fragments within an analyte. Additionally, mass spectrometry can identify components within the analyte based on a fragmentation pattern.

Analyte ions for analysis by mass spectrometry may be produced by any of a variety of ionization systems. For example, Atmospheric Pressure Matrix Assisted Laser Desorption Ionization (AP-MALDI), Atmospheric Pressure Photoionization (APPI), Electrospray Ionization (ESI), Atmospheric Pressure Chemical Ionization (APCI) and Inductively Coupled Plasma (ICP) systems may be employed to produce ions in a mass spectrometry system. Many of these systems generate ions at or near atmospheric pressure (760 Torr). Once generated, the analyte ions must be introduced or sampled into a mass spectrometer. Typically, the analyzer section of a mass spectrometer is maintained at high vacuum levels from $10^{-4}$ Torr to $10^{-8}$ Torr. In practice, sampling the ions includes transporting the analyte ions in the form of a narrowly confined ion beam from the ion source to the high vacuum mass spectrometer chamber by way of one or more intermediate vacuum chambers. Each of the intermediate vacuum chambers is maintained at a vacuum level between that of the proceeding and following chambers. Therefore, the ion beam transports the analyte ions transitions in a stepwise manner from the pressure levels associated with ion formation to those of the mass spectrometer. In most applications, it is desirable to transport ions through each of the various chambers of a mass spectrometer system without significant ion loss. Often an ion guide is used to move ions in a defined direction to in the MS system.

Ion guides typically utilize electromagnetic fields to confine the ions radially while allowing or promoting ion transport axially. One type of ion guide generates a multipole field by application of a time-dependent voltage, which is often in the radio frequency (RF) spectrum. These so-called RF multipole ion guides have found a variety of applications in transferring ions between parts of MS systems, as well as components of ion traps. When operated in presence of a buffer gas, RF guides are capable of reducing the velocity of ions in both axial and radial directions. This reduction in ion velocity in the axial and radial directions is known as "thermalizing" or "cooling" the ions ion populations due to multiple collisions of ions with neutral molecules of the buffer gas. Thermalized beams that are compressed in the radial direction are useful in improving ion transmission through orifices of the MS system and reducing radial velocity spread in time-of-flight (TOF) instruments. RF multipole ion guides create a pseudo potential well, which confines ions inside the ion guide. In constant cross section multipoles, this pseudo potential is constant along the length and therefore does not create axial forces other than at the entrances and exits. This end effect may be overcome at the entrance of the multipole ion guide with a lens or by other techniques to impart to the ions sufficient energy to enter the multipole. The exit of the multipole ion guide generally does not present an obstacle to the ions because the pseudo potential at the exit forces the ions out of the multipole ion guide in the desired direction. Known multipole ion guides normally include a comparatively large diameter entrance, which is useful for accepting ions. However, having an exit of the same large diameter is not desirable for delivering a small diameter beam from the exit. However, known ion guides not having a substantially constant cross-section create a variable pseudo potential barrier along the axis of transmission that can create axial forces, which can retard or even reflect ions. Finally, the buffer gas useful in ion cooling can also cause ion stalling in the ion guide.

What is needed, therefore, is an apparatus, which guides ions through a mass spectrometry system and that overcomes at least the shortcomings of known apparatuses described above.

BRIEF DESCRIPTION OF THE DRAWINGS

The present teachings are best understood from the following detailed description when read with the accompanying drawing figures. The features are not necessarily drawn to scale. Wherever practical, like reference numerals refer to like features.

DEFINED TERMINOLOGY

It is to be understood that the terminology used herein is for purposes of describing particular embodiments only, and is not intended to be limiting. The defined terms are in addition to the technical and scientific meanings of the defined terms as commonly understood and accepted in the technical field of the present teachings.

As used in the specification and appended claims, the terms 'a', 'an' and 'the' include both singular and plural referents, unless the context clearly dictates otherwise. Thus, for example, 'a device' includes one device and plural devices.

As used herein, the term 'multipole ion guide' is an ion guide configured to establish a quadrupole, or a hexapole, or an octopole, or a decapole, or higher order pole electric field to direct ions in a beam.

As used in the specification and appended claims, and in addition to their ordinary meanings, the terms 'substantial' or 'substantially' mean to with acceptable limits or degree. For example, 'substantially cancelled' means that one skilled in the art would consider the cancellation to be acceptable.

As used in the specification and the appended claims and in addition to its ordinary meaning, the term 'approximately' means to within an acceptable limit or amount to one having ordinary skill in the art. For example, 'approximately the same' means that one of ordinary skill in the art would consider the items being compared to be the same.

DETAILED DESCRIPTION

In the following detailed description, for purposes of explanation and not limitation, representative embodiments disclosing specific details are set forth in order to provide a thorough understanding of the present teachings. Descriptions of known systems, devices, materials, methods of operation and methods of manufacture may be omitted so as to avoid obscuring the description of the example embodiments. Nonetheless, systems, devices, materials and methods that are within the purview of one of ordinary skill in the art may be used in accordance with the representative embodiments.

Figure 1:
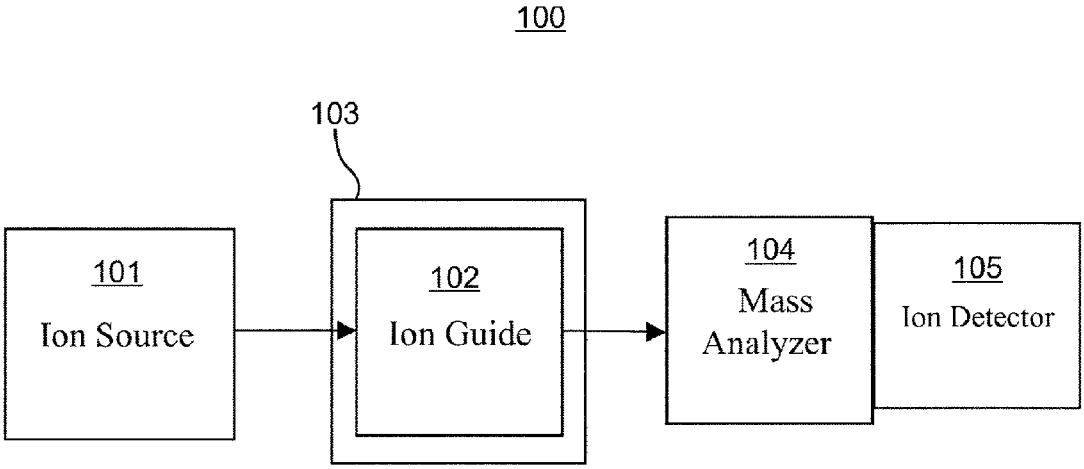
FIG. 1 shows a simplified block diagram of an MS system in accordance with a representative embodiment.

FIG. 1 shows a simplified block diagram of an MS system 100 in accordance with a representative embodiment. The MS system 100 comprises an ion source 101, a multipole ion guide 102, a chamber 103, a mass analyzer 104 and an ion detector 105. The ion source 101 may be one of a number of known types of ion sources. The mass analyzer 104 may be one of a variety of known mass analyzers including but not limited to a time-of-flight (TOF) instrument, a Fourier Transform MS analyzer (FTMS), an ion trap, a quadrupole mass analyzer, or a magnetic sector analyzer. Similarly, the ion detector 105 is one of a number of known ion detectors.

The multipole ion guide 102 is described more fully below in connection with representative embodiments. The multipole ion guide 102 may be provided in the chamber 103, which is configured to provide one or more pressure transition stages that lie between the ion source 101 and the mass analyzer 104. Because the ion source 101 is normally maintained at or near atmospheric pressure, and the mass analyzer 104 is normally maintained at comparatively high vacuum, according to representative embodiments, the multipole ion guide 102 may be configured to transition from comparatively high pressure to comparatively low pressure. The ion source 101 may be one of a variety of known ion sources, and may include additional ion manipulation devices and vacuum partitions, including but not limited to skimmers, multipoles, apertures, small diameter conduits, and ion optics. In one representative embodiment, the ion source 101 includes its own mass filter and the chamber 103 may comprise a collision chamber. In mass spectrometer systems comprising a collision chamber including the multipole ion guide 102, a neutral gas may be introduced into chamber 103 to facilitate fragmentation of ions moving through the multipole ion guide. Such a collision cell used in multiple mass/charge analysis systems is known in the art as "triple quad" or simply, "QQQ" systems.

In alternative embodiments, the collision cell is included in the source and the multipole ion guide 102 is in its own chamber 103. In a preferred embodiment, the collision cell and the multipole ion guide 102 are separate devices in the same vacuum chamber 103.

In use, ions (the path of which is which is shown by arrows) produced in ion source 101 are provided to the multipole ion guide 102. The multipole ion guide 102 moves the ions and forms a comparatively confined beam having a defined phase space determined by selection of various guide parameters, as described more fully below. The ion beam emerges from the ion guide and is introduced into the mass analyzer 104, where ion separation occurs. The ions pass from mass analyzer 104 to the ion detector 105, where the ions are detected.

Figure 2A:
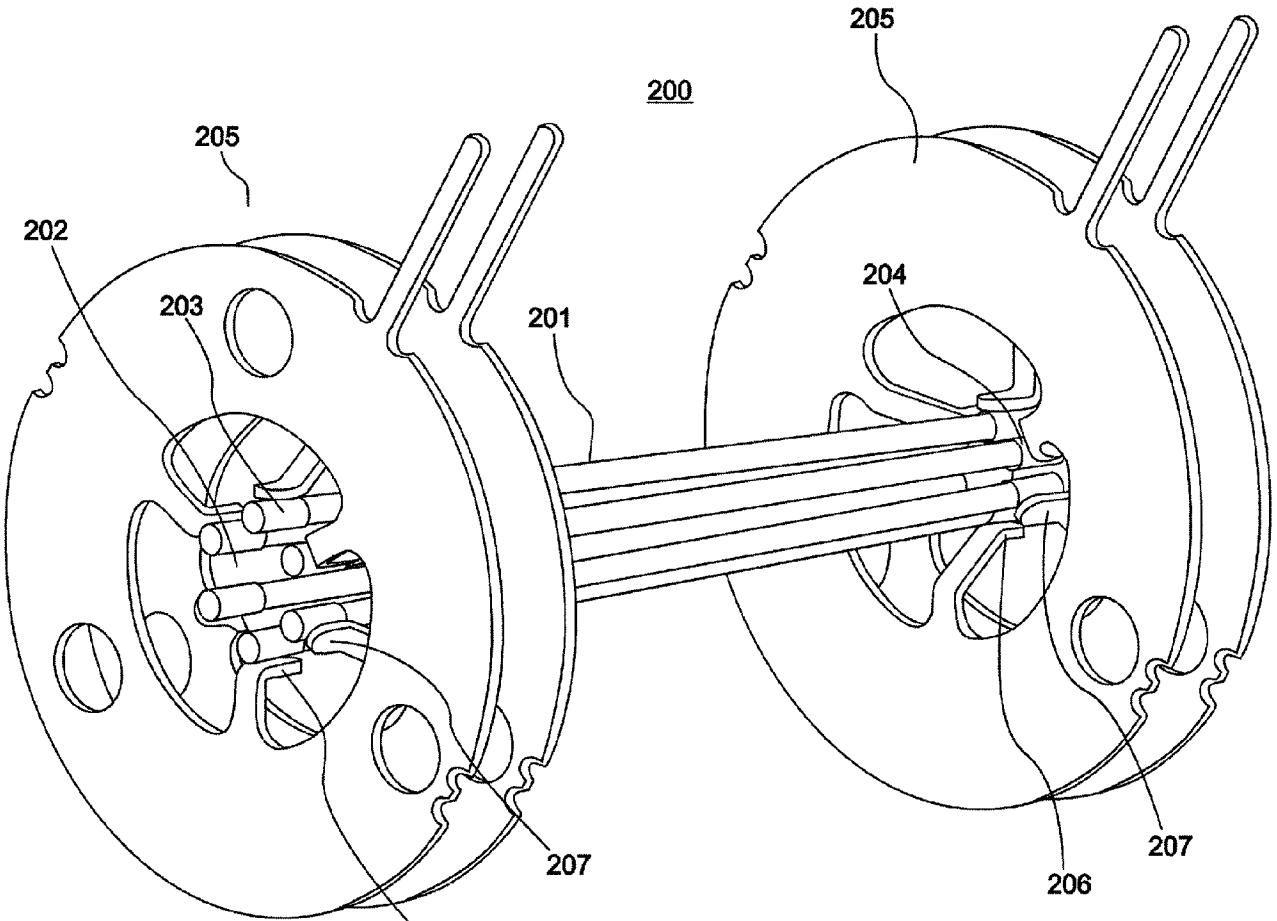
FIG. 2A shows a perspective view of a multipole ion guide in accordance with a representative embodiment.

FIG. 2A shows a perspective view of a multipole ion guide 200 in accordance with a representative embodiment. In the present embodiment the multipole ion guide 200 comprises six rods 201, and thus provides a hexapole RF field. It is emphasized that the selection of a hexapole ion guide is merely illustrative and the present teachings are applicable to other multipole ions guides. The multipole ion guide 200 comprises rods 201 in a converging arrangement having an input 202 and an output at a distal end of the input 202. In a representative embodiment described more fully below, the rods 201 are rods disposed about an axis (not shown in FIG. 2A). Each of the rods 201 comprise a first end 203 and a second end 204 remote from the first end 203, and each of the rods 201 is disposed at a respective greater distance from the axis at its first end 203 than at the second end 204. As such, the rods 201 are converging from the input 202 to the output. In a representative embodiment, the first ends 203 of the rods are arranged so that an inscribed circle connecting the first ends 203 of the rods 201 at the input 202 has a radius that is greater than a radius of an inscribed circle connecting the rods 201 at the second ends 204 of the rods 201 at the output. In other embodiments described below, the rods 201 are converging, but are not arranged at both the input 202 and the output in a symmetric arrangement.

In a representative embodiment, the rods 201 are comprise of insulating material, which can be ceramic or other suitable material. The rods 201 also comprise a resistive outer layer (not shown). The resistive layer allows for the application of a DC voltage difference between the respective first ends 203 and the respective second ends 204 of the rods 201. In another embodiment, the rods 201 may be as described in commonly owned U.S. Pat. No. 7,064,322 to Crawford, et al. and titled "Mass Spectrometer Multipole Device," the disclosure of which is specifically incorporated herein by reference and for all purposes. In this case, the rods 201 may have a conducting inner layer and resistive outer layer, which configures the rod 201 as a distributed capacitor for delivering the RF voltage to the resistive layer of the rod. The inner conductive layer delivers the RF voltage through a thin insulation layer (not shown) to the resistive layer. Such a configuration is described in the incorporated reference to Crawford, et al., and as described more fully below, serves to reduce deleterious heating of the rods 201 resulting from induced currents of the RF fields.

Rings 205 are provided to maintain the rods 201 in position, and to provide electrical connections 206, 207 to the rods 201 from a voltage source (not shown). The voltage source is configured to applying an alternating voltage between adjacent rods 201 and a DC voltage to each of the 201. The RF voltage and the DC voltage applied to the rods 201 may be made at the same electrical connection (e.g., electrical connections 206, 207), or separate connections can be made to each rod for the RF voltage and the DC voltage. Notably, the DC voltage level applied to the first ends 203 of the rods is not the same as the DC voltage level applied at the second ends 204 of the rods 201 to provide a DC field and potential drop from one end of the rods 201 to another. In representative embodiments, the DC voltage difference is selected to nullify any electrical potential barriers created by the multipole electric field, and to overcome ion stalling due to ion collisions of a buffer gas (not shown) in the multipole ion guide 200, thereby forcing the ions from the input 202 to the output of the multipole ion guide 200.

In accordance with representative embodiments, the alternating voltage is an RF voltage applied between adjacent pairs of rods and creates a multipole (in the present embodiment a hexapole) field in a region between the rods 201. As described below, the amplitude of the RF voltage can change along the lengths of the respective rods 201 or segments of rods to achieve certain desired results. Alternatively, the amplitude is maintained approximately constant between each of the rods 201 along their respective lengths. In a representative embodiment, the RF voltage typically has a frequency ($\omega$) in the range of approximately 1.0 MHz to approximately 10.0 MHz. The frequency is one of a number of ion guide parameters useful in achieving efficient beam compression and mass range of analytes. In addition, a direct current (DC) voltage is also applied to each of the rods 201 and creates an electrical potential difference between the first end 203 and the second end 204 of each of the rods 201. As described more fully below, the potential difference usefully nullifies a potential barrier created by the multipole field, and serves to force the ions from the input 202 and the output. Moreover, the potential difference allows the ions to overcome any resistance due to buffer gas in the ion guide 200.

Rods 201 are one of a variety of shapes. In certain embodiments, the rods 201 are substantially cylindrical with a substantially consistent diameter along their respective lengths. In other representative embodiments, the rods 201 have a larger diameter at their respective first ends 203 than at their respective second ends 204. In yet other embodiments, the rods 201 are tapered along their length, again with a greater diameter at respective first ends 203 than at respective second ends. The degree of the taper can be selected and the rods 201 may have a conical shape. As described more fully below, in embodiments with rods 201 comprising different diameters at first and second ends 203, 204, the diameter of the rods 201 at respective first ends 203 is selected to be comparatively large to provide a better field configuration for ion acceptance, and the diameter of the rods 201 at the respective second ends 204 is selected to be comparatively small to improve ion confinement.

Figure 2B:
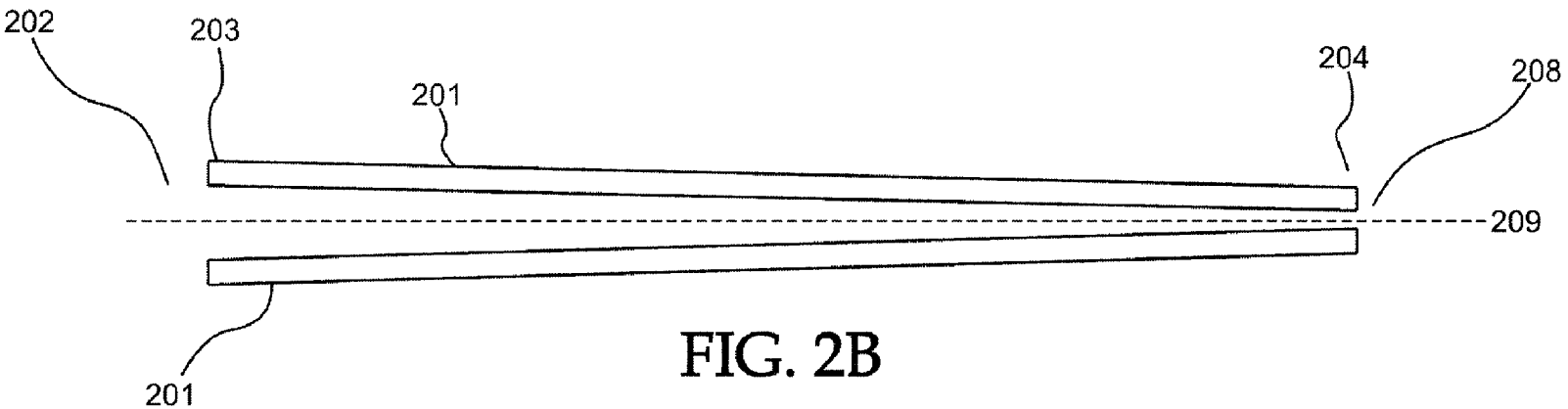
FIG. 2B shows a side view of a multipole ion guide in accordance with a representative embodiment.

FIG. 2B shows a side view of a multipole ion guide in accordance with a representative embodiment. FIG. 2B shows only two rods so that certain features of the multipole ion guide can be described with clarity. Many aspects of the multipole ion guide 200 are common to the multipole ion guide described presently. Common details are generally not repeated to avoid obscuring the presently described embodiments.

Notably, the multipole ion guide comprises the input 202 formed by the first ends 203 of the rods 201 and an output 208 formed by the second ends of the rods 201. An axis 209 extends along the length of the multipole ions guide, and in the present embodiment provides an axis of symmetry so that the first ends 203 of the rods 201 are arranged so that an inscribed circle connecting the first ends 203 of the rods 201 at the input 202 has a radius that is greater than a radius of an inscribed circle connecting the rods 201 at the second ends 204 of the rods 201 at the output 208. Moreover, the axis 209 is the center of the respective inscribed circles at the first and second ends, 203, 204 of the rods 201. The guide geometry including parameters such as guide length, the angle the rods 201 relative to the axis 209, spacing of the rods 201 and the sizes of the input 202 and output 208 impact the operating characteristics of the multipole ion guide. For example, an ion sample comprising a greater energy distribution, or a greater radial distribution, or both will require a greater area at the input 202 than an ion sample with a lesser energy and spatial distribution in order to capture a greater portion of the ions. Moreover, ions having a greater axial energy will require the length of the multipole ion guide to be comparatively greater, and thus the rods 201 to be of sufficient length to efficiently cool the ions before exiting the multipole ion guide at the output 208.

Generally, the length of the converging portion of the multipole ion guide and thus the rods 201 should be selected to allow the ions to achieve thermal equilibrium with the surrounding buffer gas. However, the greater the length of the rods, the difficult the rods are to drive electrically because of their increased capacitance. Increasing the buffer gas pressure will allow achieving more rapid thermalization; however, it may not always be convenient to increase the gas pressure because this can increase the final pressure in the mass analyzer. Alternatively, the time of ion residence in a guide can be adjusted by varying the DC bias across the rods. However, comparatively low values of DC bias can lead to ion loss and diffusional spread of ion packets. Therefore, a tradeoff between the length of the converging section of the multipole ion guide and the magnitude of the DC voltage applied is made. In representative embodiments, the length of the converging section is approximately 1 cm to approximately 10 cm, and in certain embodiments, the length is approximately 3 cm to approximately 5 cm. Notably, the length of the multipole ion guide and the angle of convergence from the input 202 to the output 208 are just two guide parameters. Other guide parameters selected for optimizing the beam guiding characteristics of the multipole ion guides of representative embodiments are described below.

Figure 2C:
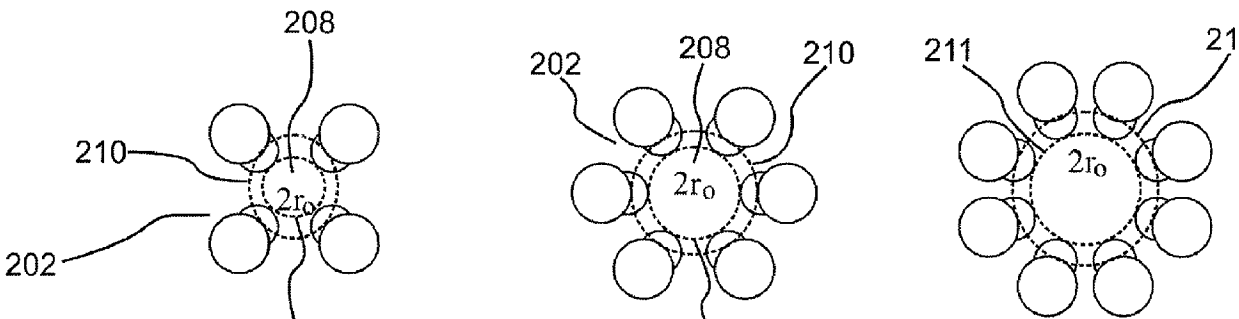
FIGS. 2C, 2D and 2E show perspective views of a quadrupole ion guide, a hexapole ion guide and an octopole ion guide, respectively, in accordance with representative embodiments.
Figure 2D:
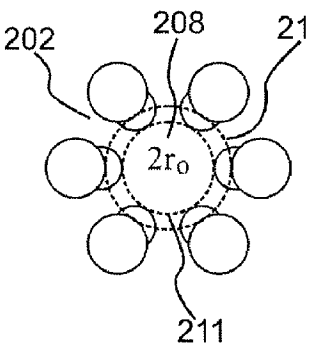
Figure 2E:
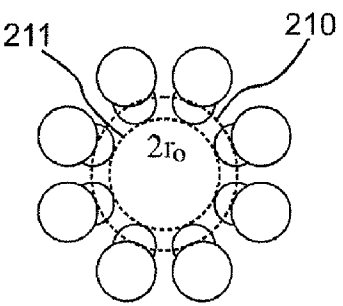

FIGS. 2C, 2D and 2E show perspective views of a quadrupole ion guide, a hexapole ion guide and an octopole ion guide, respectively, in accordance with representative embodiments. Many aspects of the multipole ion guides described above are common to the multipole ion guides described presently. Common details are generally not repeated to avoid obscuring the presently described embodiments.

FIG. 2C shows a perspective view of a quadrupole ion guide in accordance with a representative embodiment viewed from the input 202 through the guide to the output 208. The inscribed circles 210, 211 are shown.

FIG. 2D shows a perspective view of a hexapole ion guide in accordance with a representative embodiment viewed from the input 202 through the guide to the output 208. A circle 210 inscribed at the first ends 203 of the rods 204 is shown. The diameter ($2r_o$) of the circle 210 at the first end 203 is also shown. Another circle 211 inscribed at the second ends 204 of the rods 201. Circle 211 also includes a diameter (also referred to as $2r_o$). As will become clearer as the present description continues, the diameters of the inscribed circles 210, 211 are used in the determination of certain ion guide characteristics.

FIG. 2E shows a perspective view of an octopole ion guide in accordance with a representative embodiment viewed from the input 202 through the guide to the output 208. The inscribed circles 210, 211 are shown.

The number of poles affects the shape of the pseudo-potential well, which confines ions in a multipole ion guide. By an appropriate choice of guide geometry one can either increase the guide acceptance, or improve the focusing of ions. The selection of guide and rod dimensions is especially significant at the input 202 and the output 208. At the input 202, the spacing between adjacent rods 201 and the diameter of the first ends 203 of the rods 201 determine the size of the circle 210, and thus $2r_o$. A larger inscribed circle 210 translates to a larger acceptance area at the input, fostering capture of a larger energy, or spatial distribution of ions for confinement in the multipole ion guide.

However, the separation between adjacent rods at the input 202 affects the collection of ions into the guide. If the spacing between adjacent rods 201 at respective first ends 203 is too large compared to the rod diameter ion leakage in the space between adjacent rods 201 can occur. In view of the desire to provide inscribed circle 210, while minimizing the spacing between rods 201, the present teachings contemplate rods 201 having a larger diameter at their respective first ends 203 than at their second ends 204. Thus, for a desired diameter of the circle 210, the spacing between adjacent rods can be comparatively reduced by providing rods 201 having comparatively large diameters at their respective first ends. The present teachings contemplate rods 201 having a taper along their length, being conical along their length, or having an abrupt change in radius at a selected point along their length. Notably, rods 201 having substantially constant diameter along their length are suitable, especially when the multipole ion guide 200 is driven at a sufficiently high RF frequency and voltage to maintain broad band mass transmission at both ends, as described below.

At the output, the spacing of the second ends 204 of the rods 201 at the output 208 determines the extent of ion focusing. While it is useful to reduce the diameter of the inscribed circle 211 at the output to reduce ion losses, the diameter of the circle 211 sets the floor for the minimum mass that can be confined. Notably, as the diameter of the circle 211 is reduced the RF field density is comparatively high and ions less massive than a minimum value become unstable. It can be shown that the low-mass cutoff, $m_{cutoff}$, can be quantitatively expressed:

$$m_{cutoff} \propto \frac{V}{r_0^2\omega^2}$$

where V is the amplitude of the RF signal at the output and ω is the RF frequency. As should be appreciated, for a particular RF amplitude, the smaller the radius of the inscribed circle 211, the higher the cutoff mass. Thus, ions with masses below the cutoff mass are unstable and thus not appreciably confined. Because of the desire to compress the ions into a more focused beam at the output, the degree of convergence of the rods 201 at the output 208 is balanced with the mass cutoff. As such, by using rods 201 with second ends 204 having smaller radii than at the first ends, some of the deleterious effects of comparatively high RF field density can be reduced. Ultimately, an optimal ratio of the radius of the rods at respective second ends 204 to the radius of the inscribed circle 211 is found so that a comparatively broad mass range of the ions is guided in a comparatively confined beam.

In certain applications it is possible to separate temporally the periods when comparatively high mass ions and comparatively low mass low mass ions are transferred through the multipole ion guide 200. Scanning instruments, which include but are not limited to quadrupole mass filters, only analyze ions in a small mass range at any given moment. Therefore, in accordance with representative embodiments, dynamic control of multipole parameters, such as RF voltage, is provided to maximize the transmission of the specific ions traveling through the multipole ion guide 200. For instance, a comparatively lower RF voltage (e.g., approximately 50 V to approximately 150V zero-to-peak) is useful for the confinement of small mass ions, while the application of a comparatively high RF voltage (e.g., approximately 150V to approximately 400V zero-to-peak) is useful for efficient capture of comparatively large mass ions and their trajectories do not become unstable at the narrow end of the multipole ion guide.

Figure 3A:
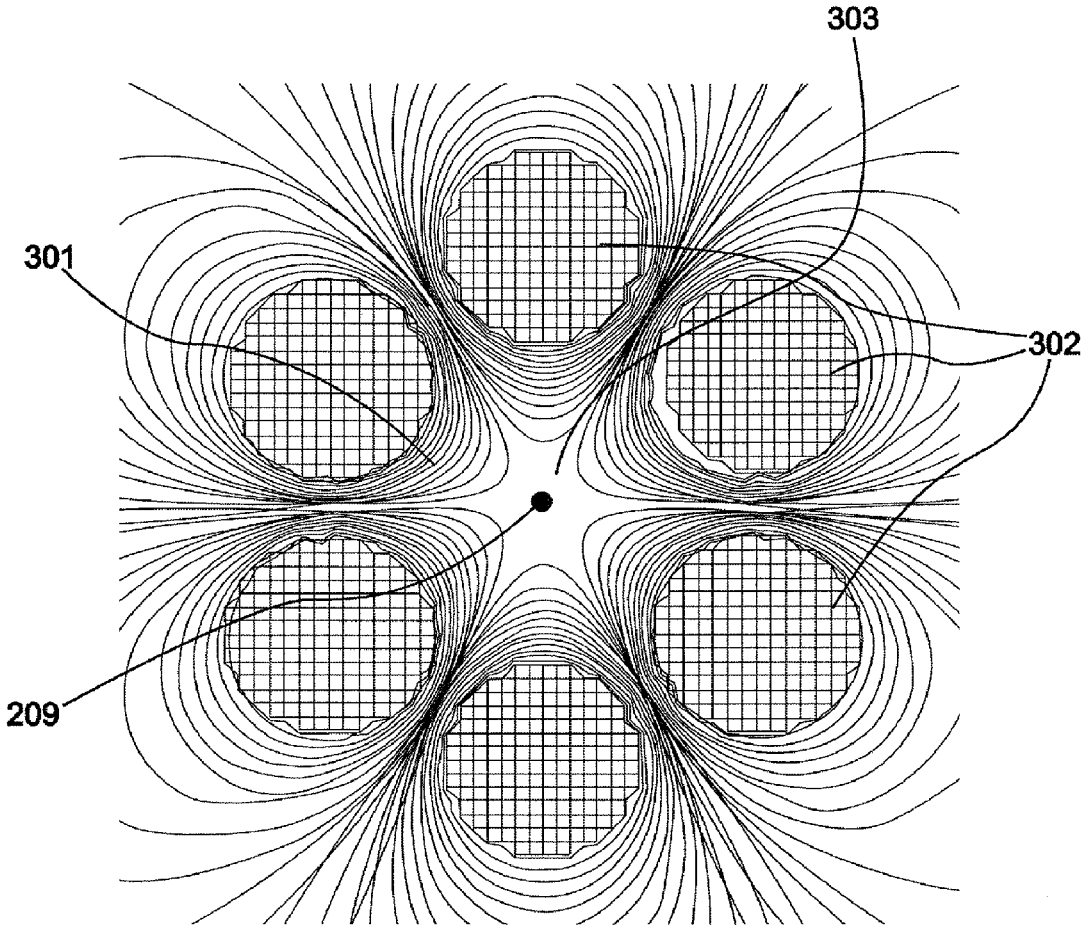
FIG. 3A shows equipotential lines generated by a hexapole ion guide in accordance with a representative embodiment.

FIG. 3A shows equipotential lines 301 generated by a hexapole ion guide in accordance with a representative embodiment. FIG. 3A shows the equipotential lines 301 viewed from the input 202. Reference characters 302 indicate the locations of the first ends 203 of the rods 201. The confinement of ions (not shown) is within region 303.

Figure 3B:
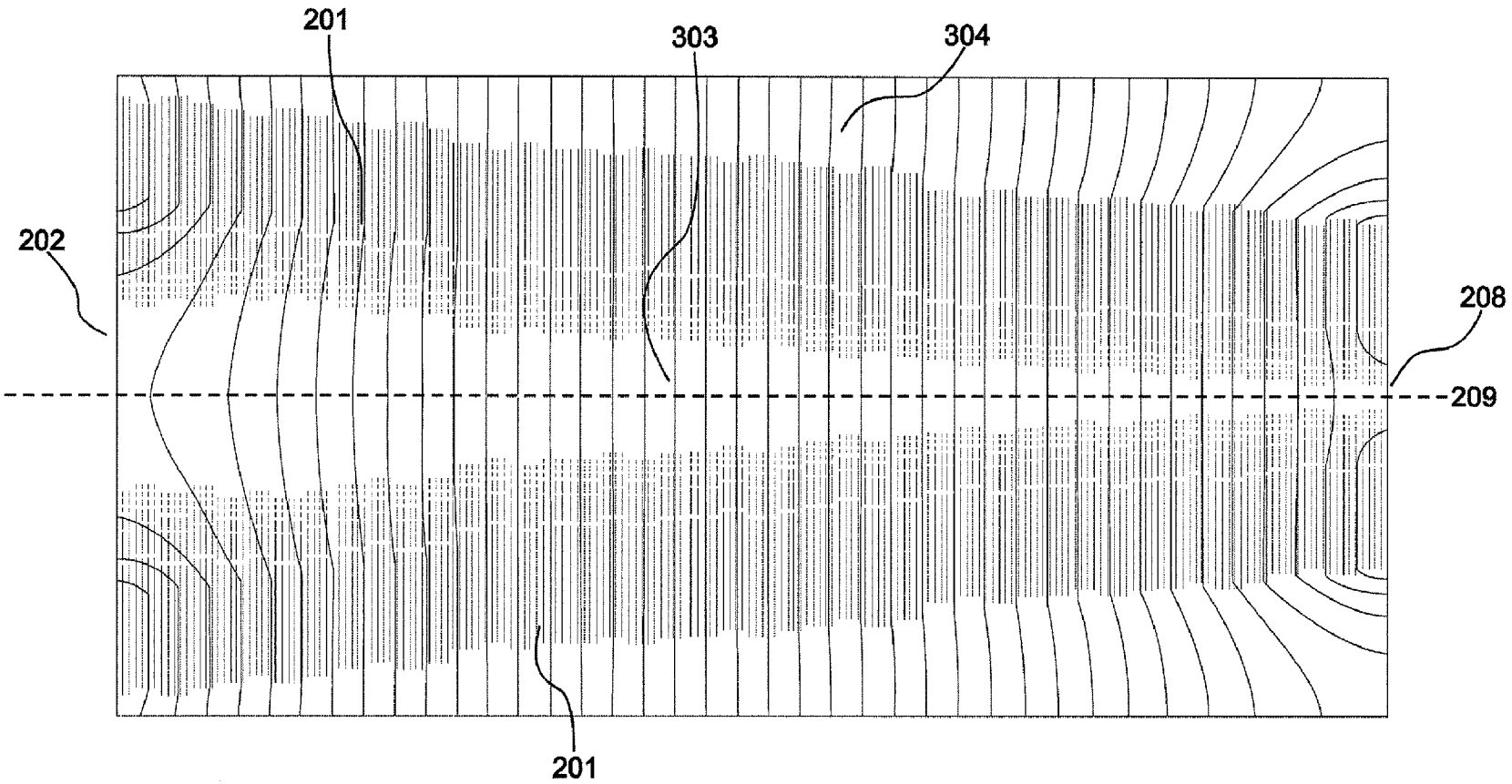
FIG. 3B shows a side view of the equipotential lines generated by a DC field in a hexapole ion guide in accordance with a representative embodiment.

FIG. 3B shows lines 304 of the DC component of the electric field generated by a hexapole ion guide in accordance with a representative embodiment. As shown, the equipotential lines 304 are substantially 'flat' across most of the confinement region 303 and are perpendicular to the axis 209. As discussed above, multipole ion guides can create retarding pseudo-potential barriers in the confinement region, and can reduce the usefulness of the ion guide. By applying a DC voltage across each of the rods 201, this potential barrier is nullified. The small DC equipotential curvature at the entrance (e.g., input 202, not shown in FIG. 3A) is not a significant concern because it can be manipulated be the relative potential of, for example, an ion optics element (not show) that is disposed in tandem with the input of the multipole ion guide. Although not shown in the FIG. 3B, often the resistance layer disposed over the rods 201 will not extend along the entire length of the rods 201 to allow the attaching of leads or rings to drive the DC and RF voltages. Such a short length of metal and the end will create a short length of fixed DC potential, but since said short fixed DC lengths occur at the end of the first ends 203 and the ends of the second ends 204, the ions adjacent these fixed DC elements can also be manipulated by the relative potential of the tandem optic elements. Beneficially, in the representative embodiment the ions are subjected to substantially constant axial DC fields, and hence to a substantially constant axial force, regardless of their position within the multipole ion guide 200. This is not the case in known multipole devices, which rely on field penetration between the rods to create an axial force. Those devices have different DC fields depending on the distance of the ion to the center and whether the ion is closer to a rod or to a gap between the rods.

Figure 4A:
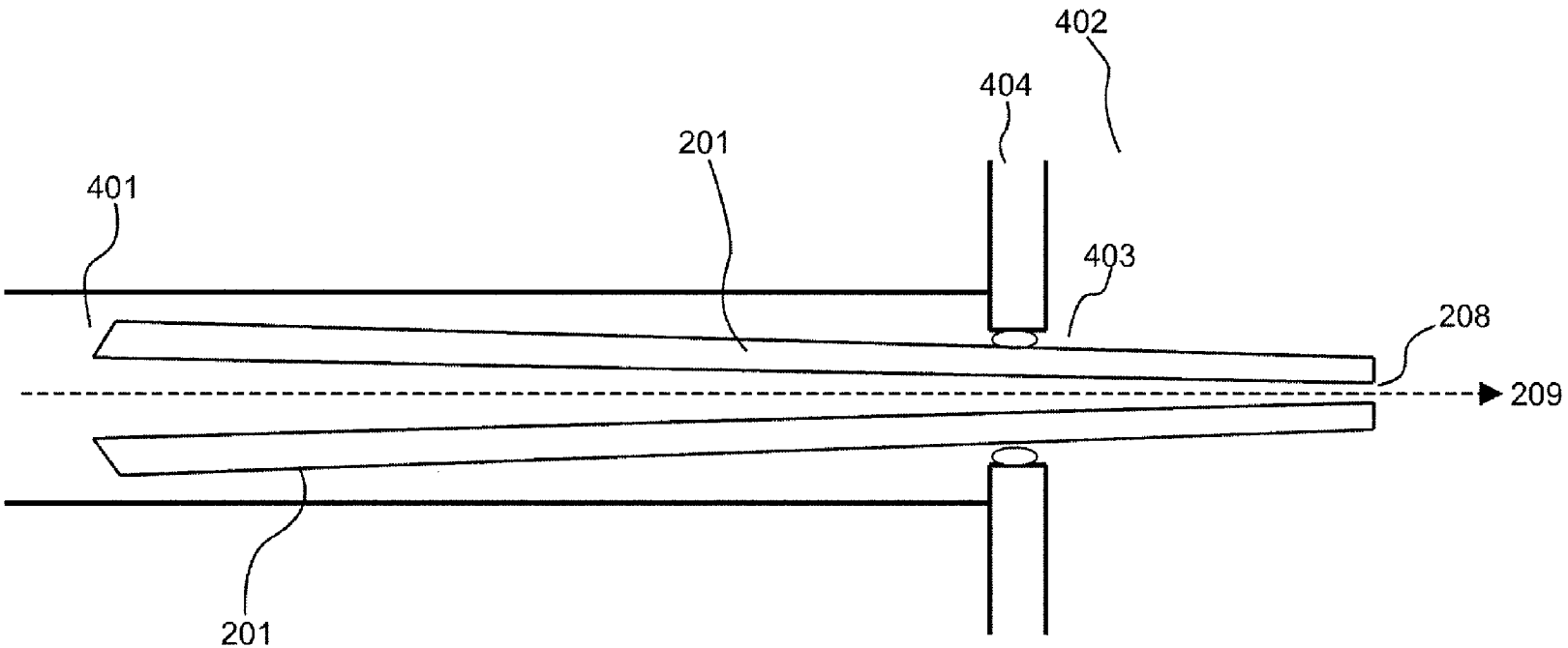
FIG. 4A shows a side view of a multipole ion guide in accordance with a representative embodiment.

FIG. 4A shows a side view of a multipole ion guide in accordance with a representative embodiment. The multipole ion guide comprises rods 201 and an axis 209 described previously. The number of poles of the ion guide of the presently described embodiment is not specified, as the presently described embodiments relate to quadrupole and higher order multipole ion guides. As described above, in mass spectrometry systems of the representative embodiments, different components are often maintained at different pressures. For example, in chamber 401, the pressure is comparatively high with the buffer gas introduced to thermalize the ions as they are moved by the ion guide. However, the thermalized ions at the output 208 are provided to a mass analyzer (not shown in FIG. 4A) that is maintained at a comparatively high vacuum. In the present embodiment, region 402 is maintained at a lower pressure than the chamber 401 and an aperture 403 is provided in a wall of the chamber 401. The rods 201 pass through the aperture 403 and the output 208 is disposed in region 402.

In order to minimize flow of the buffer gas from chamber 401 to region 402, the aperture 403 is made comparatively small. The ion beam is compressed in the ion guide and thermalized by the buffer gas and then introduced through the small aperture 403 into region 402, which is pumped down to comparatively low pressure for mass filtering. However, the smaller the aperture 403, the smaller the diameter of the output 208 must be. Reducing $r_o$ for a constant magnitude (V) and frequency (ω) of the RF voltage, the higher the mass cutoff ($m_{cutoff}$). As such, it is desirable to provide a higher magnitude RF voltage at the input 202 in order to ensure suitable ion capture from an ion source, and a lower magnitude RF voltage at the output 208. In one representative embodiment, the resistance layer of the rods along the length of each rod provides an Ohmic drop in the RF voltage along the length of the rods 201 between their respective first ends 203 and their respective second ends 204. Thereby, at the output 208, the magnitude of the RF voltage is reduced compared to the RF voltage at the input.

However, while reducing the RF voltage along the length of the rods in a converging multipole with an axial field generated by a resistance layer on the rods is beneficial in altering the RF and DC voltages, joule heating creates thermal problems. Even without intentionally dropping RF between the input and the output of the multipole ion guide, there can be significant heating due to induced RF and DC currents. For example, if the RF and DC voltages are driven from the first and second ends 203, 204 of the rods 201, there is an optimum resistance value of the rods to give minimum total power, depending of course on the desired RF and DC voltages and the capacitance of the rods to their neighbors and environment. Increasing the resistance of the rod decreases the DC loss, but the RF losses, in the form of heat then increase. For one small hexapole embodiment, the optimum resistance value is about 900 Ohm per rod, for example.

The combined DC and RF heat generated in the resistance layer of the rod 201 is difficult to mitigate from the rods because the rods are in a vacuum so convection is minimal. The result can be a raised temperature inside the multipole ion guide, which adds to the average kinetic energy of the buffer gas and ions. As a result, the objective of 'cooling' the ions can be even more challenging. This temperature can cause material failures or melted solder joints.

One way to dissipate the heat generated is by providing thermally conductive paths from the rods 201 to the chambers of the mass spectrometry system. Care should be taken, however, in the selection of material and structures for heat dissipation to avoid adding excessive electrical capacitance from rod to rod, or from rod to ground. Additional capacitance can limit the possible RF frequency or create additional load for the drive electronics.

In addition to mitigating deleterious thermal affects (both ion temperature and device temperature), the present teachings contemplate certain embodiments, which can decrease the heat generated. In one representative embodiment, another ring 205 may be provided between the rings 205 shown in FIG. 2A. This additional ring is driven with an intermediate DC voltage and the same RF voltage as the other rings 205. While the DC power loss is unchanged, the RF losses will decrease by about a factor of four, because each rod and is electrically in essence two shorter rods. Each shorter rod has half the resistance of the total rod. The capacitance is half, so current is half, and the power dissipated in each 'short' rod is reduced to one-eighth of its original dissipation. Since each actual rod has the combined loss of two 'short' rods, the total RF power is reduced by a factor of 4. As such, adding a third mounting ring requires selecting a new slightly higher optimum resistance value for the rod based on the new RF losses. One disadvantage of adding the third mounting ring is the increased overall rod to rod and rod to ground capacitance which will result. This just makes driving the structure at high RF frequency tougher.

Figure 4B:
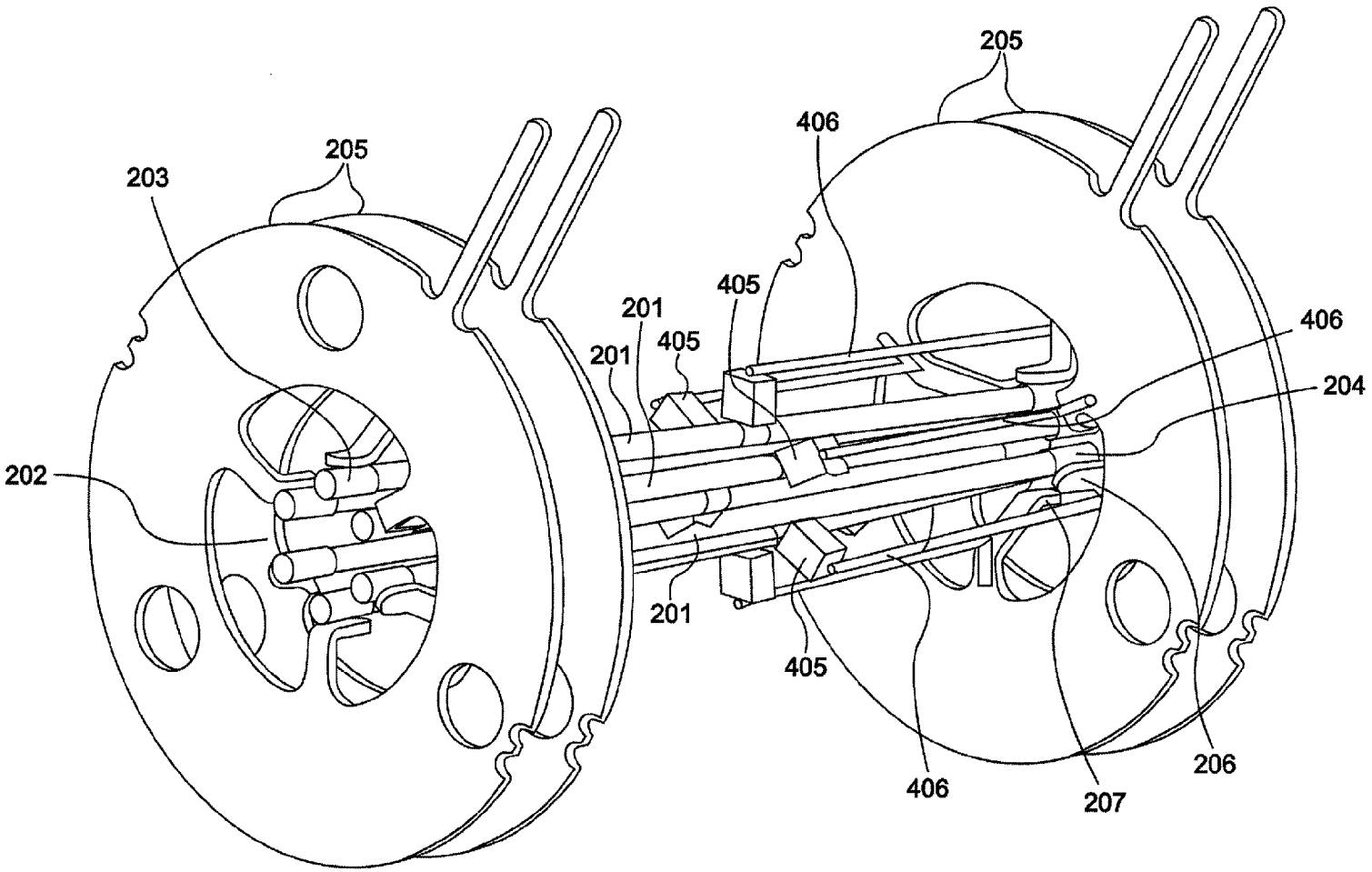
FIG. 4B shows a perspective view of a multipole ion guide in accordance with a representative embodiment.

In accordance with another representative embodiment shown in perspective view in FIG. 4B, RF energy is added at a point along each rod 201 without adding as much stray capacitance. Instead of adding a complete mounting ring in the region between rings 205, a comparatively small capacitor 405 is added to couple RF energy from either of the first and second ends 203, 204 of each of the rod 201 to the center of the rod 201 via connections/cables 406, which are connected to respective AC and DC voltage sources (not shown). The value of the capacitor 405 does not need to be large for it to achieve most of the approximately four-fold reduction of the RF losses. For example, using a value of capacitance of approximately 100 times or more of the capacitance between adjacent rods 201 is contemplated. Because the coupling is capacitive, no additional DC voltage needs to be generated, and the capacitor only has to be rated for either the DC drop or the RF drop, whichever is greater. As with the case of adding a center mounting ring, there would be a new (higher) optimum rod resistance value for minimum total power. It should be apparent that one optimum point to attach the RF voltage from the coupling capacitor is not in the center, but rather closer to the output 208 because the local rod to rod capacitance is greater at the output 208. It noted that more than one RF input could be added, with a capacitor for each to avoid shorting out the DC gradient.

In another representative embodiment, the rods 201 comprise a distributed capacitor for delivering the RF to the resistive surface of the rod. An inner metal core delivers the RF through a thin insulation layer to the resistive layer. This technique of coaxial capacitive coupling in a multipole is described in the incorporated reference to Crawford, et al. In a non-converging multipole ion guides the reduction of RF sag is important to maintaining the maximum mass bandwidth. In converging multipole ion guides of the representative embodiments, the mass bandwidth (assuming the first and second ends 203, 204 are both driven at the same RF voltage (V)) is generally not dictated by the RF sag near the middle of the length of the rods 201, but rather by the different band pass centers of the input 202 and the output 208. If the resistance value is substantially constant along the length, coaxial coupling reduces the RF losses significantly. A new optimum resistance value to minimize total power becomes apparent. With RF losses scaled down, the use of very high resistance values in the resistive layer is now possible. For example, 10 kOhm, 100 kOhm, 1 MOhm or greater resistance values are contemplated depending on the ratio of the resistance layer thickness to rod diameter and length. The DC losses would then be reduced by orders of magnitudes. Beneficially, thermal issues of the converging multipole are mitigated, which increases reliability and substantially avoids increasing the ion thermal energy.

In a representative embodiment, the rods 201 may be made of metal, with concentric insulating layer and resistive layers. The insulation layer may be fabricated by anodizing metal. Aluminum and Tantalum are among the possible metals which can be anodized. In the case of Tantalum, 500 Angstroms to 2000 Angstroms of anodization will result in the necessary DC breakdown resistance. Although one end (but not both) of the resistance layer can be attached to the center metal rod, it is not required to attach either of the electrodes at the first and second ends 203, 204 to the metal under the anodization layer. Rather, a purely capacitive coupling both in and out of the metal core can be implemented. It is noted that other methods of creating an insulating layer are contemplated, including painting or dipping on an organic or inorganic insulator, and various vapor deposition and sputtering techniques. Selecting a metal and insulator combination with a high melting point, such and tantalum and tantalum oxide, has an advantage in that the subsequent steps of adding a resistance layer and electrodes can utilize high temperature processes, some of which require temperatures of approximately 800° C. to 1500° C. Such temperatures can are excessive for materials such as aluminum or organic insulators.

In certain representative embodiments, a decreasing RF amplitude is applied between the input 202 and the output 208 comprises rods 201 each of which comprises segments. Each rod segment is driven at a different RF value from taps on one or more transformers or from capacitive dividers. However multiple segments can lead to ion losses, increased mechanical complexity, and increased electrical capacitance that needs to be driven. In a representative embodiment, the RF amplitude is decreased along the rod length by selecting a capacitance per unit length (of rod), measured between the metallic core and the resistance layer, that is of a similar order of magnitude as the rod to rod capacitance per unit length. The two capacitances then function as a capacitive divider. Beneficially, in this embodiment the magnitude of the RF voltage then does not need to be the same at the first ends 203 of the rods 201 as at the second ends 204 of the rods 201. In general, as described above the converging multipole of representative embodiments beneficially have a higher RF voltage applied at the input 202 that at the output 208.

Figure 4C:
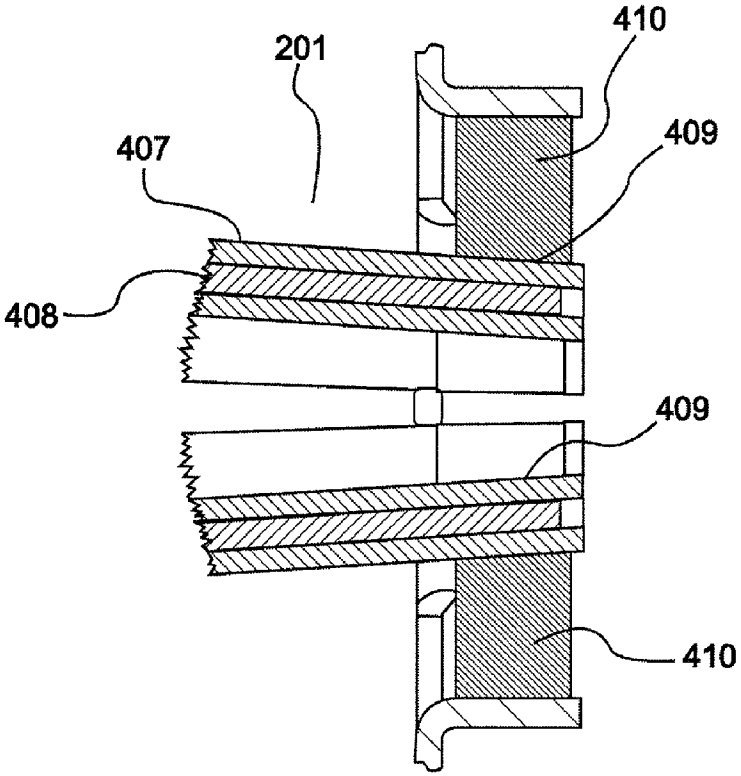
FIG. 4C shows a cross-sectional view of rods at an end of a multipole ion guide in accordance with a representative embodiment.

The naturally increasing capacitance between rods 201 of the converging multipole ion guides results in a distributed capacitance divider. For example, if rod 201 comprises an inner metal core and an outer ceramic layer with diameters chosen to give you approximately the same capacitance to the resistive layer as the resistive layer has to the opposite RF polarity rods, a variable capacitive divider is effected. Since the rod to rod capacitance is greater at the output than at the input due to inter-rod spacing, even with a constant capacitance per unit length center core, a decreasing RF along the rod from entrance to exit can be achieved. Very high resistance on the order of approximately 10 kOhm to approximately $10^5$ kOhm is useful to avoid significant axial RF currents and their corresponding RF losses. In one embodiment, as shown in FIG. 4C the rod starts as an insulating tube 407 surrounding a metal core 408. This could be a glass tube shrunk onto a wire for example. The metal core 408 does not go all the way to the end of the insulating tube 407 nearest the output 208 in order to avoid surface breakdown. The insulating tube 407 comprises a resistive layer 409 disposed circumferentially thereabout, but is provided along a portion of the end nearest the output 208, thereby away from the end of the insulating tube 407 to avoid excessive RF currents. The resistive layer 409 comprises an electrically conductive layer (not shown) thereover to facilitate connection to contacts on the rings.

In the present embodiment, the rings nearest to the input 202 are configured to apply both RF and DC voltages to the rods 201. A single ring is provided at the end nearest the output 208 to apply a DC voltage but no RF voltage. Illustratively, the ring nearest the output 208 is RF blocked to the rods with large value chip resistors 410, preferably 50 kOHM to 20 MOhm. The resistive layer 409 on the rod would likewise have to have a large end to end resistance, such as in the range of approximately 50 kOhm to approximately 20 MOhm. The applied voltage to the ring at the output should be adjusted to set desired output voltage at the surface of the rod. Other RF blocking schemes are of course possible, including refinements which tie the like-phase rods together before blocking the RF and connecting to the DC. In the representative embodiment of FIG. 4C, the RF voltage is driven from only the end of rods 201 nearest the input 202, and delivers a decreasing RF voltage to the surface of the resistance layer between the input 202 and the output 208. The geometries and resistances can be adjusted to get the desired DC gradient and RF gradient. Other embodiments are possible which deliver RF to both ends without the blocking resistors, and would need four rings each configured to apply an RF voltage to the rods 201. In such an embodiment it is more difficult to drive the components of the multipole ion guide at high frequency because of the increased capacitance.

In yet another representative embodiment, a wire or a conductive trace may be applied to a side of each rod 201 away from the ion path. In this embodiment, the resistance layer does not surround each rod, but rather is disposed only on the side of each rod facing the ion path, with a gap between the resistance layer and the wire or conductive trace on the backside away from the ions. The conductive trace or wire is connected to the RF source and drives the RF voltage variably. The trace or wire could be an electrode not actually touching the rod 201, but very close to the rod, as long as the electrode capacitance to the resistive layer is comparable to the rod to rod resistance. In this embodiment, comparatively high resistance values are required in the resistive layer and additional capacitive coupling to electrodes connected to the DC source may be necessary to compensate for mounting ring capacitance. The RF voltage at the surface of the rod is always less than the applied RF and decreases as you go from the entrance to the exit. Since the reduction is achieved through capacitive division rather than resistive attenuation, the total RF loss can be kept quite small. And since the axial resistance can be set quite high, the DC power can also be kept quite small. Hence, the total power is small, the device runs cool, and the ions have less thermal energy. Finally, and most significantly, these alternatives which allow the RF at the exit to be less than at the entrance allow for a greater geometry compression ratio for a given desired mass bandwidth. You can either increase the RF at the entrance and make the entrance physically larger and capture more ions without disturbing the exit, or you can keep the same RF and geometry at the entrance and reduce the diameter and the RF at the exit and still transmit the low mass. A greater reduction of phase space can therefore be achieved. It should also be noted that the advantages of the listed alternatives here also apply to a squished or non circular multipole as described elsewhere in this application.

Figure 5A:
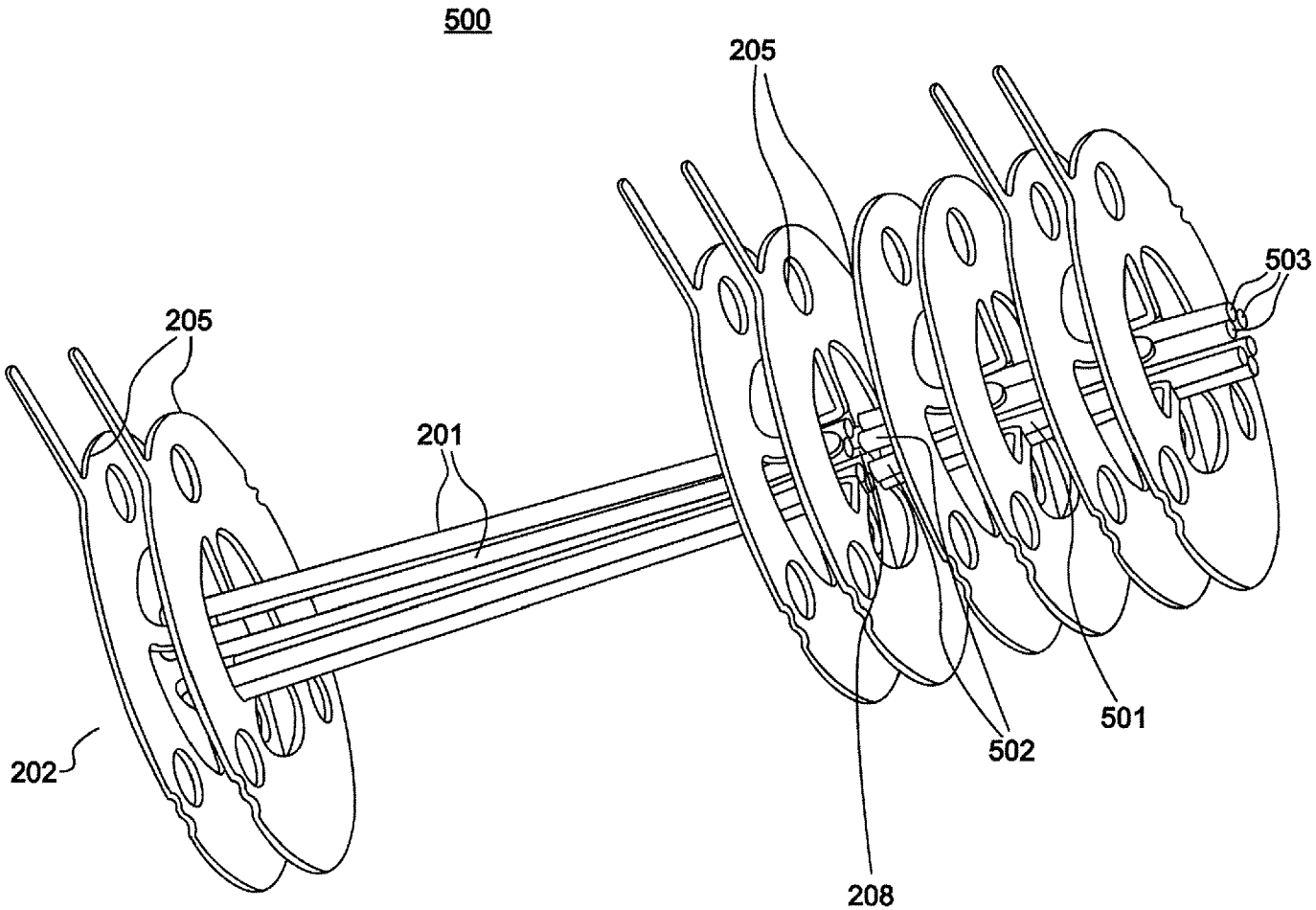
FIG. 5A shows a perspective view of a hexapole ion guide in accordance with a representative embodiment.

FIG. 5A shows a perspective view of a hexapole ion guide 500 in accordance with a representative embodiment. It is emphasized that the selection of a hexapole ion guide is again merely illustrative and the present teachings are applicable to other multipole ions guides. The hexapole ion guide 500 includes features common to those of previously described embodiments. Many common details are not repeated to avoid obscuring the present embodiment.

The hexapole ion guide 500 comprises rods 201 in a converging arrangement having input 202 and output at a distal end of the input 202. In a representative embodiment described more fully below, the rods 201 are rods disposed about axis 209. Each of the rods 201 comprise first end 203 and second end 204 remote from the first end 203 as described previously, and each of the rods 201 is disposed at a respective greater distance from the axis 209 at its first end 203 than at the second end 204. In a representative embodiment, the first ends 203 of the rods are arranged so that an inscribed circle connecting the first ends 203 of the rods 201 at the input 202 has a radius that is greater than a radius of an inscribed circle connecting the rods 201 at the second ends 204 of the rods 201 at the output.

The hexapole ion guide comprises a rods 501 disposed in tandem with the rods 201. The rods 501 each comprise a first end 502 and a second end 503, with the first ends adjacent to output 208. The rods 501 are substantially symmetrically disposed about axis 209. Rings maintain the rods in position and are configured to connect the rods to RF and DC voltage sources. The rods 501 are not arranged in a converging manner, but rather are arranged substantially equidistant from the axis along their respective lengths between respective first and second ends 502,503.

The hexapole ion guide 500 provides ion beam compression between the input 202 and the output 208 as described above. However, because the beam is compressed at the output 208, the magnitude of the RF voltage can be reduced at the first end 502, thereby reducing low mass ion loss. Moreover, and as described more fully below, the rods 501 may be disposed in a region at reduced pressure (e.g., in a mass analyzer). As such, much lower or no DC voltage is required to move the ions because buffer gas collisions are eliminated and because the electrical potential barrier is lower due to a lower RF voltage applied.

Figure 5B:
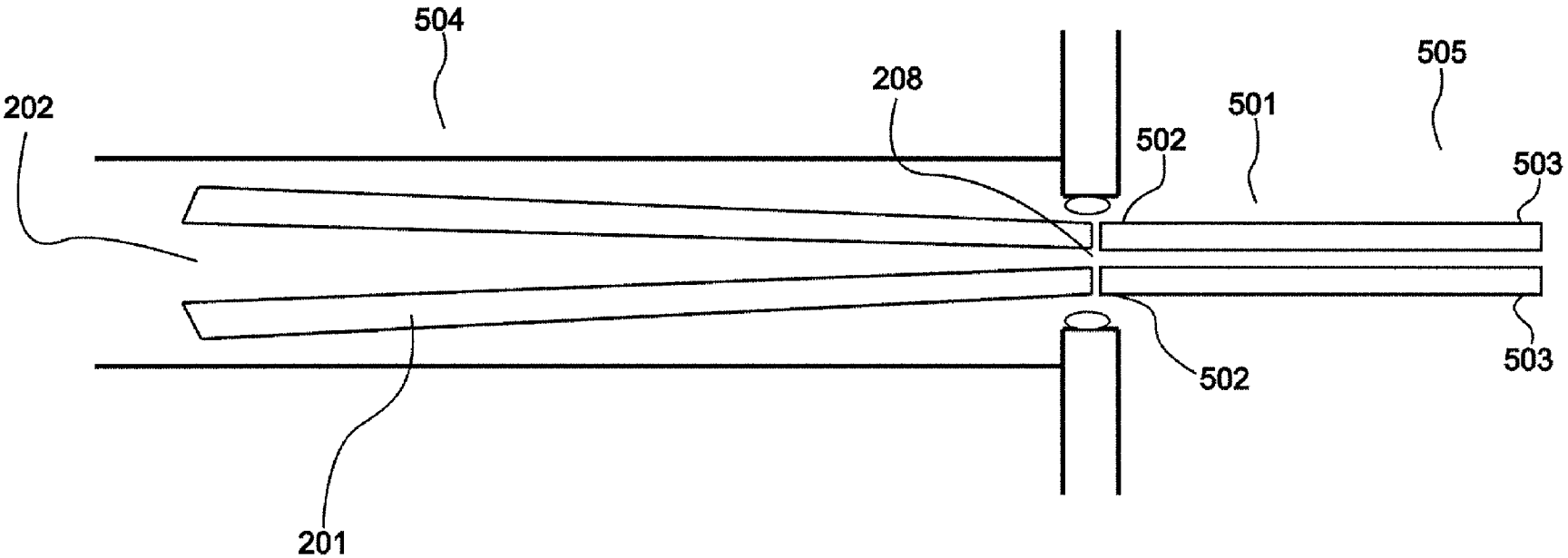
FIG. 5B shows a side view of a multipole ion guide in accordance with a representative embodiment.

FIG. 5B shows a side view of a multipole ion guide in accordance with a representative embodiment. The multipole ion guide comprises rods 201 disposed about axis 209 described previously. The number of poles of the ion guide of the presently described embodiment is not specified, as the presently described embodiments relate to quadrupole and higher order multipole ion guides. As described above, in mass spectrometry systems of the representative embodiments, different components are often maintained at different pressures. For example, in chamber 504, the pressure is comparatively high with the buffer gas introduced to thermalize the ions as they are moved by the ion guide. However, the thermalized ions at the output 208 are provided to a mass analyzer (not shown in FIG. 5B) that is maintained at a comparatively high vacuum. In the present embodiment, region 505 is maintained at a lower pressure that the chamber 504, and an aperture 506 is provided in a wall 507 of the chamber 504. The output 208 formed by rods 201 are adjacent to the first end 502 formed by rods 501.

In order to minimize flow of the buffer gas from chamber 504 to region 505, the aperture 506 is made comparatively small. The ion beam is compressed in the ion guide and thermalized by the buffer gas and then introduced through the small aperture 506 to the first end, which is pumped down to comparatively low pressure for mass filtering. However, the smaller the aperture 506, the smaller the diameter of the output 208 and the first end 502 must be. As described previously, reducing $r_o$ for a constant magnitude (V) and frequency ($\omega$) of the RF voltage, the higher the mass cutoff ($m_{cutoff}$). As such, it is desirable to provide a higher magnitude RF voltage at the input 202 in order to ensure suitable ion capture from an ion source, and a lower magnitude RF voltage at the first end 502. Because the rods 501 are not connected to the rods 201, the application of a lower RF voltage, if any, to the rods 501 at the input is readily effected without concern for the magnitude of the applied RF voltage at the input 202. It is important to provide ion transfer from the output 208 to the first end 502 occur without substantial loss of focusing effect of the ions. Therefore it is necessary to match the frequency and the phase of the corresponding RF power supplies connected to the rods 201 and 501.

Figure 6A:
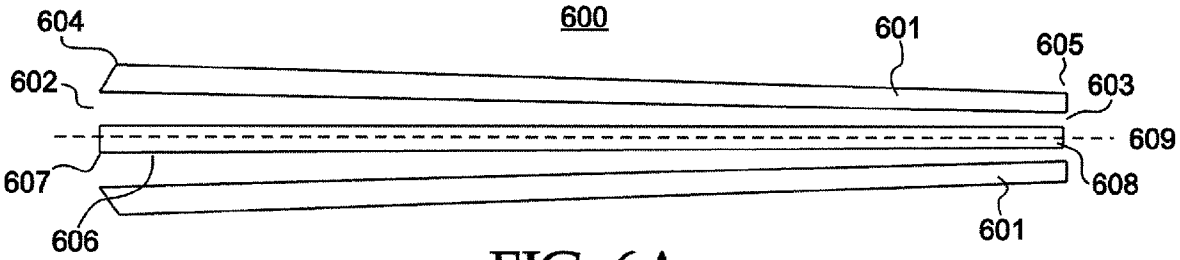
FIG. 6A shows a side view of a multipole ion guide in accordance with a representative embodiment.

FIG. 6A shows a perspective view of a multipole ion guide 600 in accordance with a representative embodiment. Certain details of the multipole ion guides described in connection with representative embodiments above are common to the multipole ion guide 600 and are generally not repeated in order to avoid obscuring the description of the multipole ion guide 600. The ion guide comprises an input 602 and an output 603. The multipole ion guide 600 comprises first rods 601 having first ends 604 and second ends 605, and second rods 606 having first ends 607 and second ends 608. The first and second rods 601,606 are arranged in a converging manner from the input 602 to the output 603 about an axis 609 but, unlike the embodiments described above in connection with FIGS. 2A through 5B, are not disposed about inscribed circles at both ends. Rather, and as will become clearer as the present description continues, first ends 604, 607 of first and second rods 601, 606, respectively are disposed in a first circle (not shown in FIG. 6A) having a first radius, the second ends 608 of second rods 606 are disposed at opposing ends of a diameter of a second circle (not shown in FIG. 6A) having a second radius, and the second ends 605 of the remaining first rods 601 are disposed within the second circle. The multipole ion guide 600 receives an ion beam at the input 602 and creates a field pattern within the ion guide that provides compression of ion beam in one direction so that a comparatively 'flat' beam is formed at the output 603. If the separation of opposing first rods 601 is small enough that compressed beam will get separated in multiple compressed ion beams. The extent of isolation of these beams from each other will also depend on the ion mass.

The multiple ion beams comprise a cross-section that is substantially one-dimensional, and comprise a comparatively wide range of simultaneously transmitted masses. The resultant narrow final profile of the multiple beams can be particularly useful in MS applications requiring a comparatively low velocity spread in one dimension, such as with TOF analyzers.

Figure 6B:
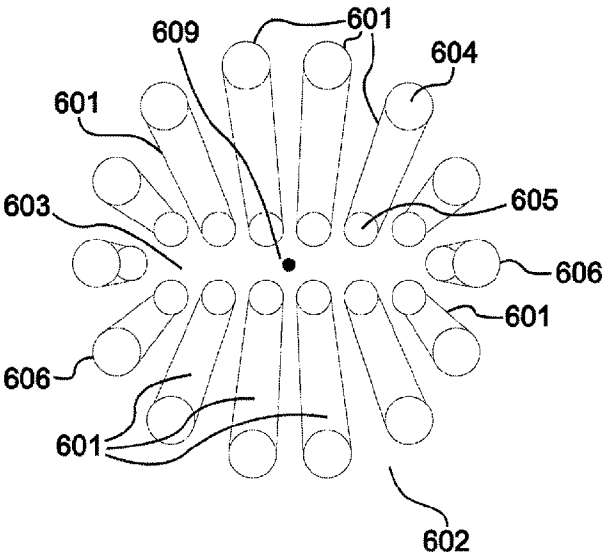
FIG. 6B shows a perspective view of a multipole ion guide in accordance with a representative embodiment.

FIG. 6B shows a perspective view of a 14-pole ion guide in accordance with a representative embodiment viewed from the input 602 through the multipole ion guide 600 to the output 603. The first circle 610 is inscribed along the interior of the first ends 604, 607 of the first and second rods 601, 606. The diameter 612 of the second circle 611 is shown. The second ends 608 of second rods 606 are disposed on the diameter, and the second ends 605 of the first rods 601 are disposed inside the second circle 611. Thus, at the input 602 the first ends 604, 607 of first and second rods 601, 606, respectively are substantially symmetric about the first circle and the axis 609; the second ends 605 of the first rods 601 are opposing one another inside the second circle 611; and the second ends 608 of the second rods 606 are disposed along the diameter 612 of the second circle 611. Simulations show that at the converging guide ions tend to form discrete beams located between the opposing rods with the same polarity if the separation between the opposing second ends 605 of the first rods 601 is small enough; for example, the separation between opposing second ends 605 is approximately equal to the separation between adjacent second ends 605 of first rods 601.

Figure 7:
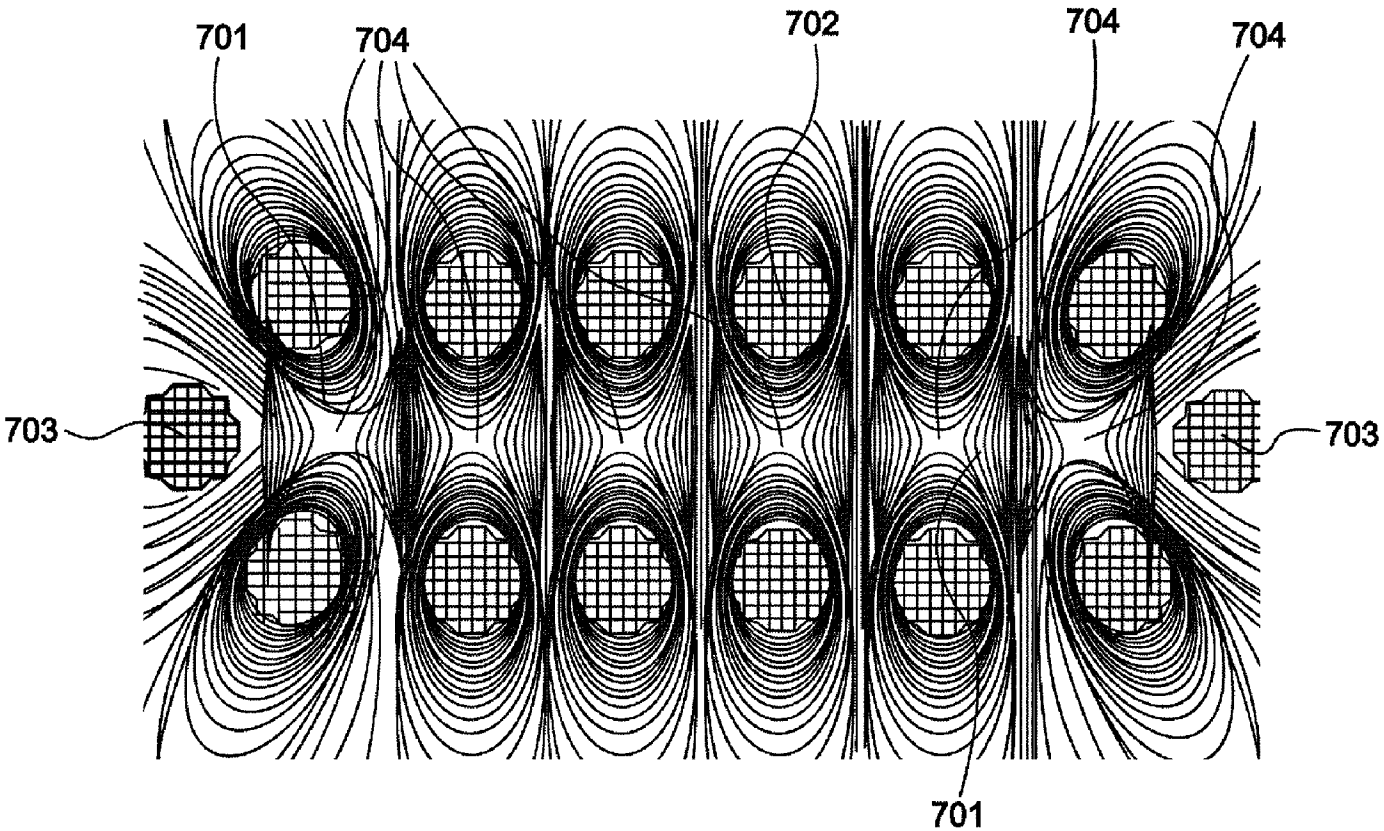
FIG. 7 shows equipotential lines generated by a 14-pole ion guide in accordance with a representative embodiment.

FIG. 7 shows equipotential lines 701 generated by a 14-pole ion guide in accordance with a representative embodiment. The equipotential lines 701 viewed from the input 602. Reference characters 702 indicate the locations of the first ends 604 of first rods 601, and reference characters 703 indicate locations of the first ends 607 of second rods 606. The confinement of ions (not shown) is within regions 704. The size of the potential well in the confinement of ions between the opposing rods is comparatively small and very tight focusing is possible. Notably, ions enter the input 602 and are confined in regions 704 as multiple beams as described above. In the 14-pole field generated, six beams are formed and provided at the output 603.

Figure 8:
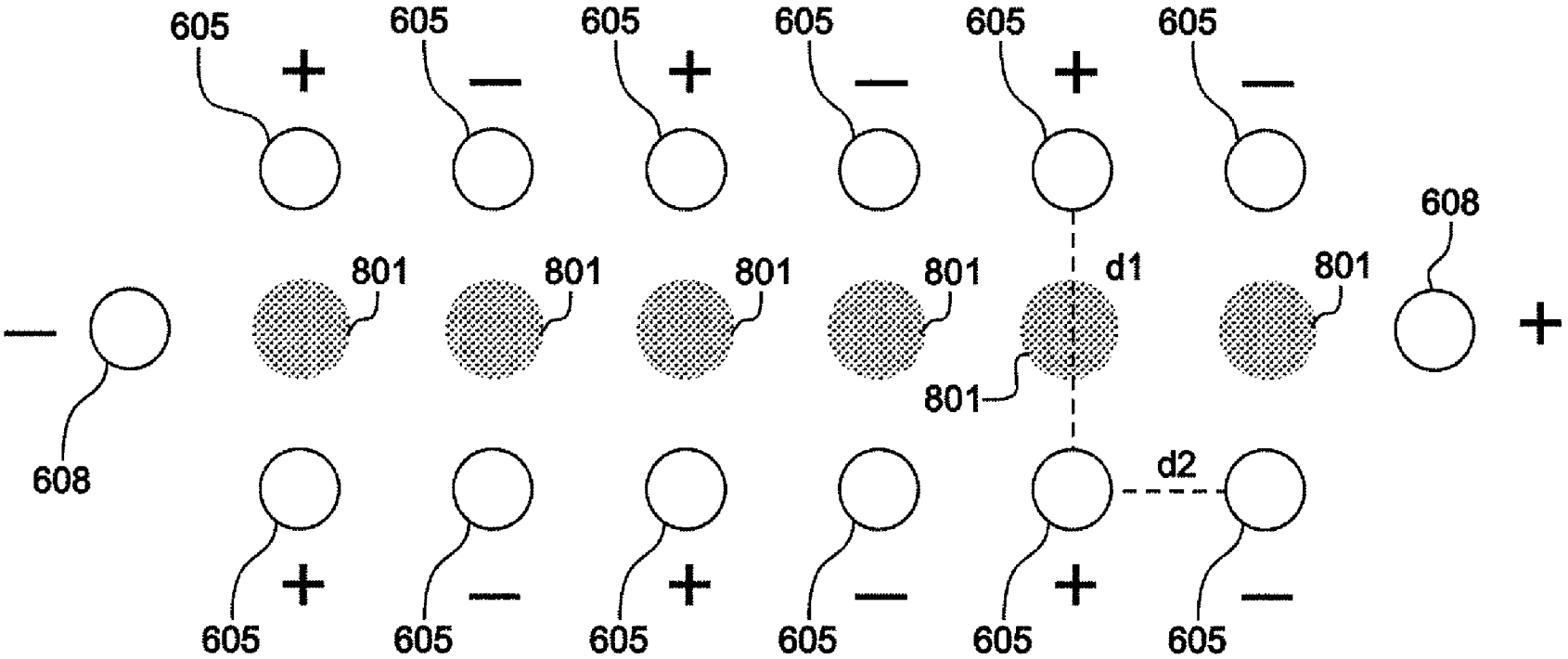
FIG. 8 shows ion beams formed by a 14-pole ion guide in accordance with a representative embodiment.

FIG. 8 shows ion beams 801 formed by a 14-pole ion guide, with second ends 605, 608 of first and second rods 601 and 606, respectively, placed for perspective. As such, the ion beams 801 are arranged as shown at the output 603 of the multipole ion guide 600. The size of the potential well between the opposing rods 601 is comparatively small and relatively tight focusing can be realized: in the range of approximately 2/1 to approximately 40/1. Also shown is a distance (d1) between opposing second ends 605 of first rods 601 and a distance (d2) between second ends 605 of adjacent first rods 601. As the distance d1 approaches the distance d2, the ion beams 801 are better isolated and more compressed, and thus have a smaller spread or area. Analysis shows that the field shape in this geometry is somewhat similar to a number of adjacent quadrupolar fields. FIG. 8 illustrates the final positions of ion beams which reflect the minima of the RF potential. This way one RF ion guide can combine very wide acceptance area with high degree of ion focusing. While a ratio of $d1/d2=\sqrt{3}$ is found to work well, larger and smaller ratios are also contemplated. With smaller ratios, the beam at the input 602 is divided into multiple channels. However, less aggressive flattening of the multipole can still be beneficial. For example, generally, many geometries taken at a cross section of FIG. 6A could be used as the output. While the beam compression may not be as great, and channelization into multiple beams may be less distinct or may not occur, the beam at the input 602 is nevertheless compressed at the output compared to its size at the substantially circular input 602. One additional benefit of the embodiment having the rods terminated before the ion beam is fully flattened is a greater mass band width, and a little more space between the rods. Although not shown, this partially flattened exit alternative is somewhat elliptically shaped and the resulting field geometry is a combination of quadrupolar and higher order multipolar terms.

Notably, the 14-pole ion guide 600 is merely illustrative and the number of poles arranged in this manner is not limited to this by upper or lower bound. As such, the numbers of rods can thus be 6, 8, 10, 12, 14 and greater. Regardless of the number of poles selected, it is preferred that the opposing electrodes at the output (e.g., output 603) of the multipole ion guide have the same polarity, and this is most easily accomplished by using 6, 10, 14, 18 rods or more because then the rods can be arranged in two parallel rows of rods 702 with one terminating rod 703 on each side. Illustratively, the number of distinct somewhat quadrupolar transmission regions which are created with such a configuration is equal to $n=2m+2$, where n=number of rods, and m=number of discrete transmission regions at the exit. One useful geometry is achieved when the position of each end rod 703 is set to create a substantially vertical field line (not shown) connecting the two rods 702 adjacent to the end rod 703. Examining FIG. 7, while the filed lines are not shown, the equipotential lines show a good symmetry of the substantially quadrupolar field channels, but close examination suggests that a further movement of the end rods 703 horizontally away from the center might be even better. Increasing the number of rods fosters an increase in the diameter of the first circle 610 without distances between individual rods becoming too large. On the other hand, regardless of the number of poles selected, a significant difference between the area of the input 602 and the area of the output 603 of the multipole ion guide 600 may lead to reduced ion mass transmission window.

Figure 9:
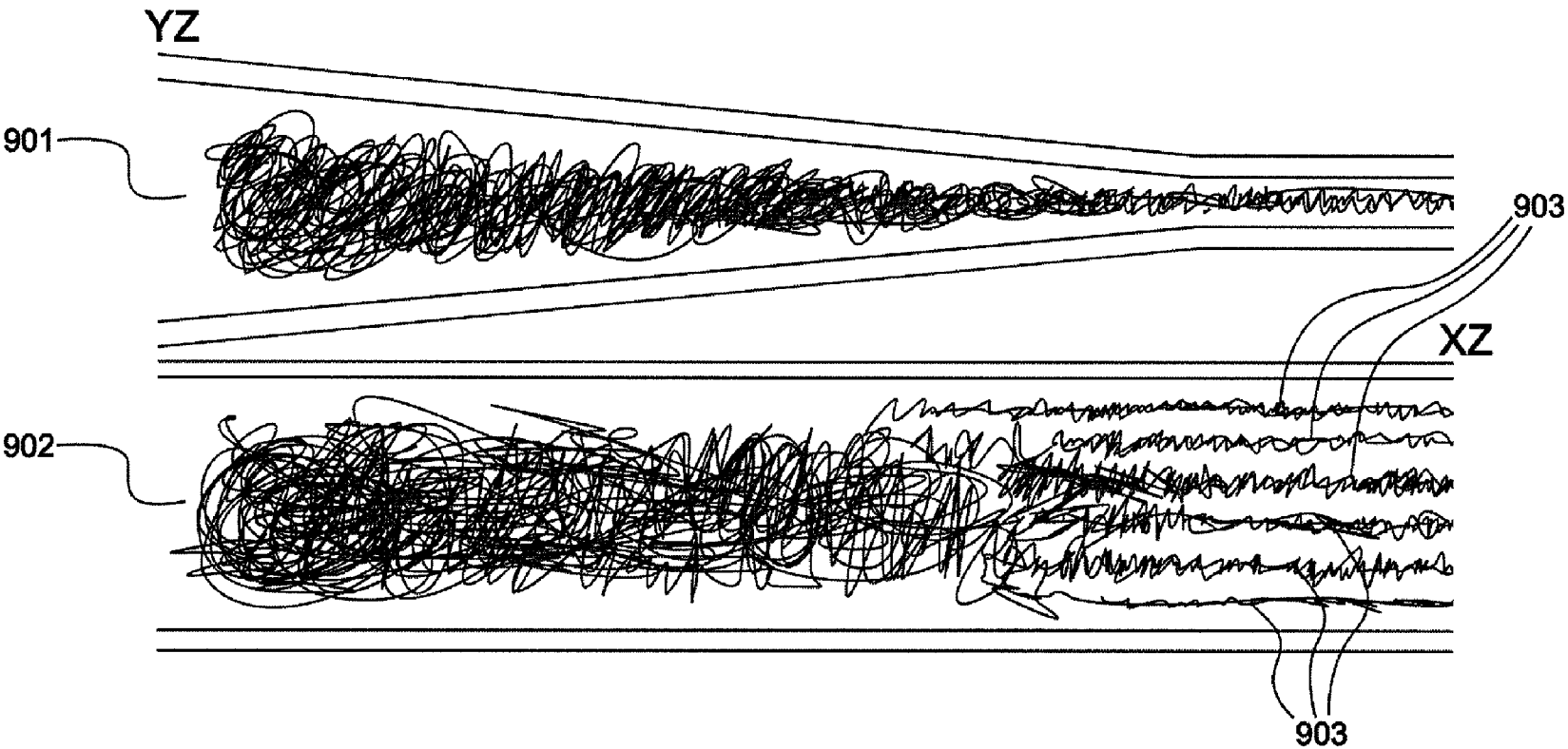
FIG. 9 shows simulations of ions guided by the 14-pole ion guide, and the formation of discrete ion beams located between the opposing rods with the same polarity in accordance with a representative embodiment.

FIG. 9 shows simulations of ions guided by the 14-pole ion guide 600, and the formation of discrete ion beams located between the opposing rods with the same polarity. Reference character 901 is directed to the simulation from the side of the multipole ion guide 600 (along the y-z plane in the coordinate system shown in FIG. 6A), and reference character 902 is directed to the simulation from the 'top' of the ion guide (along the x-z plane). The analysis shows that the field shape in this geometry is somewhat similar to quadrupolar fields.

Figure 10:
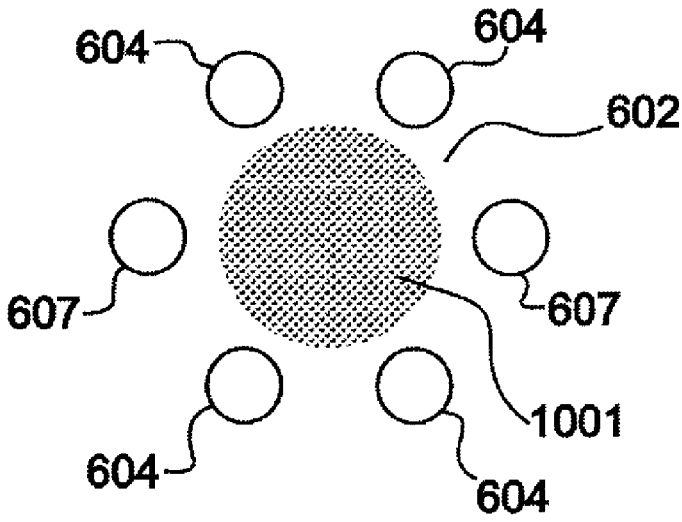
FIG. 10 shows the splitting of an input ion beam at the input of a hexapole ion guide into multiple ion beams at the output of the hexapole ion guide in accordance with a representative embodiment.
Figure 10:
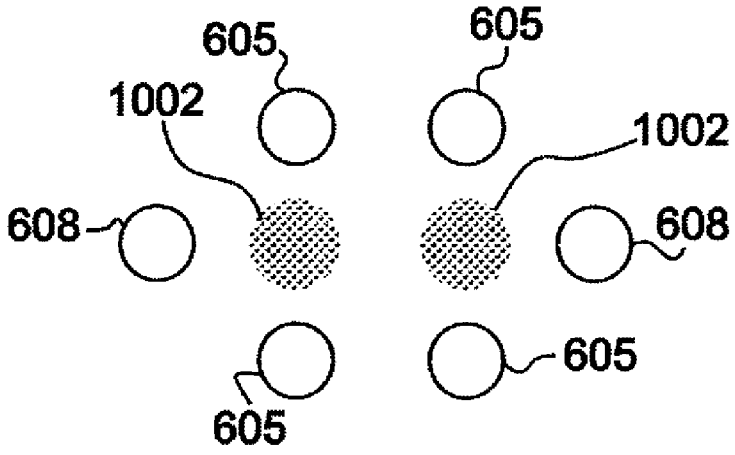

FIG. 10 shows the splitting of an input ion beam 1001 at the input 602 of a hexapole ion guide into ion beams 1002 at the output 603 of the hexapole ion guide. The first ends 604, 607 of the first and second rods 601 and 606, respectively, and the second ends 605, 608 of first and second rods 601 and 606, respectively, placed for perspective.

Figure 11A:
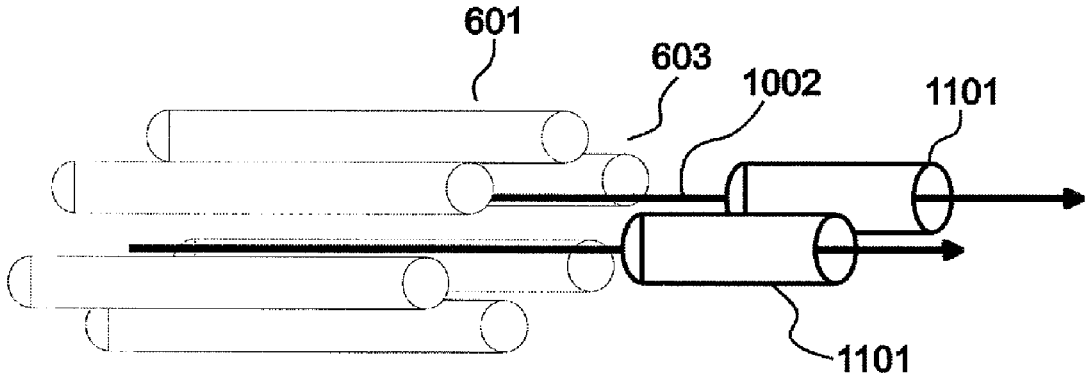
FIGS. 11A and 11B show perspective views of a multipole ion guide in accordance with a representative embodiment.
Figure 11B:
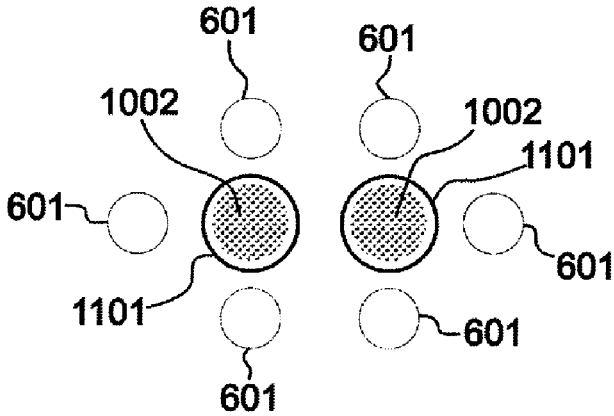

FIGS. 11A and 11B show the embodiment of FIG. 10 with the addition of subsequent lens elements 1101 for manipulating the now separated beams in perspective view and end view. A single exit lens (not shown) comprising two openings may be provided with one opening for each beam. Once the beams are separated, they can be manipulated individually to send them to different analyzers or detectors, or to further compress individually. Similar to the embodiments described in connection with FIG. 5B, adjoining a converging and flattened multipole to a matching flattened but straight multipole at the same or lower RF voltage allows for reducing the energy further and maintaining confinement while dropping the gas pressure. It is also noted that the flattened geometries benefit from a smaller vacuum conductance if the ions pass through a tube connecting two vacuum regions. For example in the case of the 14 pole ion guide the axial gas conductance is reduced markedly for the flattened embodiment compared to the circular converging embodiment.

Figure 12A:
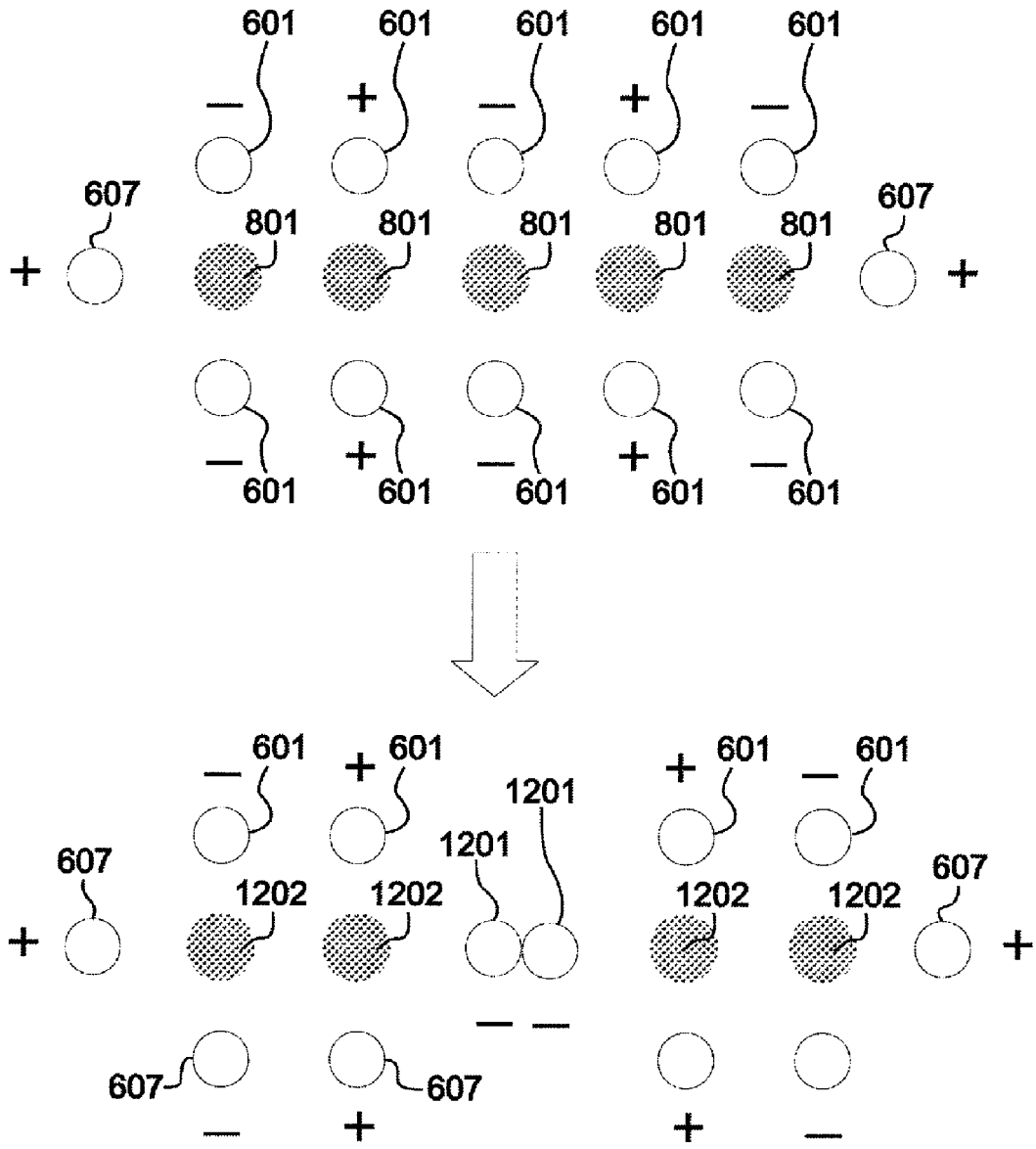
FIG. 12A shows a perspective view ion beam-splitting with a multipole ion guide in accordance with a representative embodiment.
Figure 12B:
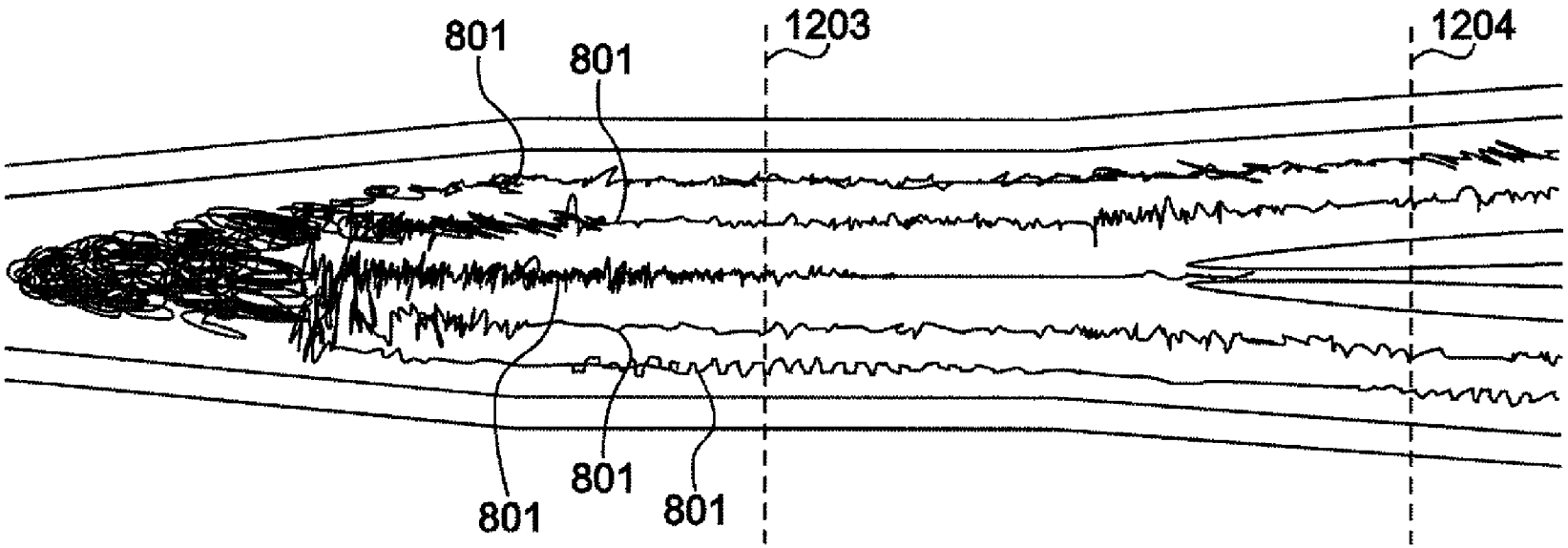
FIG. 12B shows simulated beam-splitting with the multipole ion guide of the representative embodiment of FIG. 12A.

FIGS. 12A and 12B show a representative embodiment for splitting an ion beam in two using converging multipoles. At the output (along plane 1203 into plane of page of FIG. 12B), beams 801 are provided by a 12-pole ion guide. As described previously, the ion guide assumes the "flattened shape" and small ion beams 801 are formed at the plane 1203. Two central electrodes 1201 are provided moving towards the center until they are located side by side (as shown). As a result, two hexapole guides are created that can be further separated to provide separated ion beams 1202 along plane 1204 in FIG. 12*b*. As before, the number of first and second rods 601, 606 are selected for the desired order multipole. Illustratively, 8, 12, 16 rods are arranged to provide octopole, 12-pole and 16-pole ion guides, respectively. While this is an effective approach to beam splitting, when splitting occurs after the formation of smaller beams, the centermost beam in the multipole can be lost when two middle electrodes are displaced (as shown in FIG. 12B illustrating the corresponding simulation result).

Figure 13:
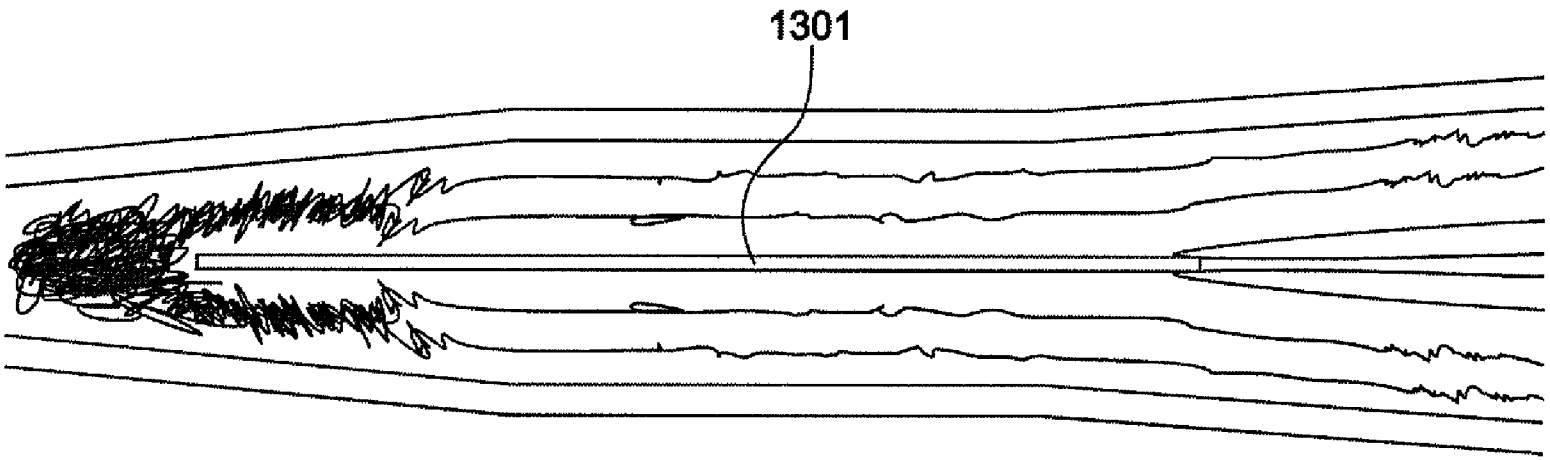
FIG. 13 shows simulated beam-splitting in accordance with a representative embodiment.

FIG. 13 shows a representative embodiment for splitting an input ion beam without losing a significant portion of ions. Notably, the ions are split into two beams before the individual beams are formed. An electrode 1301, which may have but is not limited to a "wedge" shaped, carrying the same RF voltage polarity as the two middle rods, is introduced at a certain position in the input of the guide. The introduction of this electrode forces ions to move around it thus splitting into two beams. Subsequently, both resulting beams are further compressed and may or may not form multiple individual beams, as shown in FIG. 13 in the simulation of ion paths.

In view of this disclosure it is noted that the methods and devices can be implemented in keeping with the present teachings. Further, the various components, materials, structures and parameters are included by way of illustration and example only and not in any limiting sense. In view of this disclosure, the present teachings can be implemented in other applications and components, materials, structures and equipment to needed implement these applications can be determined, while remaining within the scope of the appended claims.

The invention claimed is:

1. A multipole ion guide, comprising:

rods disposed about an axis, each of the rods having a first end and a second end remote from the first end and a substantially constant diameter between the first end and a second end, wherein each of the rods is disposed at a respective greater distance from the axis at the first end than at the second end;

means for applying a radio frequency (RF) voltage between adjacent pairs of rods, wherein the RF voltage creates a multipole field in a region between the rods;

means for applying a direct current (DC) voltage drop along a length of each of the rods; and an input comprising a geometry configured to create radio frequency (RF) multipolar field of order hexapolar or greater;

an output comprising a geometry configured to create two or more substantially quadrupolar RF field regions; and a transition region between the input and the output where the RF multipolar field of order hexapolar or greater transitions to the substantially quadrupolar RF fields.

2. A multipole ion guide as claimed in claim 1, wherein the first ends of the rods are disposed substantially symmetrically about the axis.

3. A multipole ion guide as claimed in claim 1, wherein the second ends of the rods are disposed substantially symmetrically about the axis at the second end.

4. A multipole ion guide as claimed in claim 1, wherein the first ends are disposed about a first circle having a first radius and the second ends are disposed about a second circle having a second radius, and the first radius is greater than the second radius.

5. A multipole ion guide as claimed in claim 1, wherein the first ends of the rods are disposed in a first chamber, the second ends of the rods are disposed in a second chamber and the second chamber is at a lower pressure than the first chamber.

6. A mass spectrometry system comprising the multipole ion guide of claim 1.

7. A multipolar ion guide as claimed in claim 1, wherein the order of the multipolar RF field is n and a number of distinct substantially quadrupolar RF field regions created at the output is m, and wherein n=2m+2.

8. A multipole ion guide, comprising:

rods disposed about an axis, each of the rods having a first end and a second end remote from the first end, each of the rods being disposed at a respective greater distance from the axis at the first end than at the second end, wherein the first ends of the rods are disposed about a first circle having a first radius, the second ends of two rods are disposed along a diameter of a second circle having a second radius, and the second ends of the remaining rods are disposed within the second circle;

means for applying a radio frequency (RF) voltage between adjacent pairs of rods, wherein the RF voltage creates a multipole field in a region between the rods; and means for applying a direct current (DC) voltage drop along a length of each of the rods.

9. A multipole ion guide as claimed in claim 8, wherein the second ends of the remaining rods are disposed in opposing pairs along first and second lines.

10. A multipole ion guide as claimed in claim 9, wherein the second ends of the remaining rods along the first line are spaced from one another by a first distance, the second ends of the remaining rods along the second line are spaced from another by the first distance, and the second ends of respective opposing pairs of the remaining rods are spaced apart by a second distance that is greater than the first distance.

11. A multipole ion guide as claimed in claim 10, wherein the rods are first rods and the ion guide further comprises second rods in tandem with the first rods.

12. A multipole ion guide as claimed in claim 11, wherein the second rods are separated from the second ends of the first rods by a gap.

13. A multipole ion guide as claimed in claim 12, wherein the first rods are disposed in a first chamber, the second rods are disposed in a second chamber, and the second chamber is at a lower pressure than the first chamber.

14. A multipole ion guide as claimed in claim 8, wherein each of the rods has a substantially constant diameter between the first end and a second end.

15. A multipole ion guide as claimed in claim 8, wherein each of the rods has a taper between the first end and the second end.

16. A mass spectrometry system comprising the multipole ion guide of claim 8.

17. A multipole ion guide as claimed in claim 8, configured to create an input of a radio frequency (RF) multipolar field of order hexapolar or greater, an output of two or more substantially quadrupolar RF field regions; and comprising a transition region between the input and the output where the RF multipolar field of order hexapolar or greater transitions to the substantially quadrupolar RF fields.

18. A multipole ion guide, comprising:

an input comprising a geometry configured to create radio frequency (RF) multipolar field of order hexapolar or greater; and an output comprising a geometry configured to create two or more substantially quadrupolar RF field regions; and a transition region between the input and the output where the RF multipolar field of order hexapolar or greater transitions to the substantially quadrupolar RF fields, wherein the order of the multipolar RF field is n and a number of distinct substantially quadrupolar RF field regions created at the output is m, and wherein n=2m+2.

19. A mass spectrometry system comprising the multipole ion guide of claim 18.

20. A multipole ion guide, comprising:

a plurality of rods configured to a create radio frequency (RF) multipolar field region of order hexapolar or greater at an input to the multipole ion guide, and two or more quadrupolar RF field regions at an output, wherein each of the plurality of rods contributes to the creation of more than one of the quadrupolar fields.

21. The multipole ion guide of claim 20, wherein the ion guide comprises an electrode configured to carry the same RF voltage polarity as two middle rods of the plurality of rods to result in the splitting of ion beams.

22. A mass spectrometry system comprising the multipole ion guide of claim 20.

* * * * *

UNITED STATES PATENT AND TRADEMARK OFFICE

CERTIFICATE OF CORRECTION

PATENT NO. : 8,193,489 B2
APPLICATION NO. : 12/474160
DATED : June 5, 2012
INVENTOR(S) : James L. Bertsch et al.

It is certified that error appears in the above-identified patent and that said Letters Patent is hereby corrected as shown below:

In column 18, line 8, in Claim 7, delete "multipolar ion" and insert -- multipole ion --, therefor.

In column 19, line 1, in Claim 18, after "create" insert -- a --.

In column 20, line 1, in Claim 20, delete "guide," and insert -- guide --, therefor.

In column 20, line 2, in Claim 20, delete "at an output," and insert -- downstream, --, therefor.

Signed and Sealed this
Second Day of April, 2013

Teresa Stanek Rea

Teresa Stanek Rea
*Acting Director of the United States Patent and Trademark Office*